US011519307B2

(12) United States Patent
Baltrucki

(10) Patent No.: US 11,519,307 B2
(45) **Date of Patent: *Dec. 6, 2022**

(54) VALVE ACTUATION SYSTEM COMPRISING IN-SERIES LOST MOTION COMPONENTS DEPLOYED IN A PRE-ROCKER ARM VALVE TRAIN COMPONENT AND VALVE BRIDGE

(71) Applicant: Jacobs Vehicle Systems, Inc., Bloomfield, CT (US)

(72) Inventor: Justin D. Baltrucki, Canton, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/805,343

(22) Filed: Jun. 3, 2022

(65) Prior Publication Data

US 2022/0298935 A1 Sep. 22, 2022

Related U.S. Application Data

(63) Continuation-in-part of application No. 17/247,481, filed on Dec. 12, 2020, now Pat. No. 11,408,310.
(Continued)

(51) Int. Cl.
*F01L 13/06* (2006.01)
*F01L 1/18* (2006.01)
(Continued)

(52) U.S. Cl.
CPC ..... *F01L 13/065* (2013.01); *F01L 1/181* (2013.01); *F01L 1/2411* (2013.01);
(Continued)

(58) Field of Classification Search
CPC . F01L 1/047; F01L 1/146; F01L 1/181; F01L 1/2411; F01L 1/2422;
(Continued)

(56) References Cited

U.S. PATENT DOCUMENTS 6,450,144 B2 9/2002 Janak et al.
8,578,901 B2 11/2013 Ruggiero et al.
(Continued)

FOREIGN PATENT DOCUMENTS

JP H08158901 A 6/1996
JP H09317421 A 12/1997
(Continued)

OTHER PUBLICATIONS

International Search Report & Written Opinion of the International Searching Authority for International Application No. PCT/IB2020/061865 dated Feb. 22, 2021, 7 pages.
(Continued)

*Primary Examiner* — Jorge L Leon, Jr.
(74) *Attorney, Agent, or Firm* — Moreno IP Law LLC

(57) ABSTRACT

A valve actuation system comprises a valve actuation motion source configured to provide a main valve actuation motion and an auxiliary valve actuation motion for actuating at least one engine valve via a valve actuation load path. A lost motion subtracting mechanism is arranged in a pre-rocker arm valve train component and configured, in a first default operating state, to convey at least the main valve actuation motion and configured, in a first activated state, to lose the main valve actuation motion and the auxiliary valve actuation motion. Additionally, a lost motion adding mechanism is arranged in a valve bridge and configured, in a second default operating state, to lose the auxiliary valve actuation motion and configured, in a second activated state, to convey the auxiliary valve actuation motion, wherein the lost motion adding mechanism is in series with the lost motion subtracting mechanism in the valve actuation load path.

11 Claims, 15 Drawing Sheets

Related U.S. Application Data

(60) Provisional application No. 63/202,255, filed on Jun. 3, 2021, provisional application No. 62/948,107, filed on Dec. 13, 2019.

(51) Int. Cl.

| | |
|---|---|
| ***F01L 1/26*** | (2006.01) |
| ***F01L 1/24*** | (2006.01) |
| *F01L 1/245* | (2006.01) |
| *F01L 1/46* | (2006.01) |
| *F01L 1/14* | (2006.01) |
| *F01L 1/047* | (2006.01) |

(52) U.S. Cl.

CPC ..... *F01L 1/2422* (2013.01); *F01L 1/267* (2013.01); *F01L 1/047* (2013.01); *F01L 1/146* (2013.01); *F01L 2001/2427* (2013.01); *F01L 2001/256* (2013.01); *F01L 2001/467* (2013.01)

(58) Field of Classification Search

CPC ..... F01L 2001/2427; F01L 2001/256; F01L 1/267; F01L 2001/467; F01L 13/0005; F01L 2013/001; F01L 13/06

USPC ..... 123/90.16, 90.39, 90.4, 90.61

See application file for complete search history.

(56) References Cited

U.S. PATENT DOCUMENTS

| | | | | |
|---|---|---|---|---|
| 9,611,767 | B2 | 4/2017 | Baltrucki | |
| 9,790,824 | B2 | 10/2017 | Baltrucki et al. | |
| 2001/0023671 | A1* | 9/2001 | Vorih | F01L 13/06 123/90.27 |
| 2014/0238015 | A1 | 8/2014 | Roberts et al. | |
| 2014/0326212 | A1* | 11/2014 | Baltrucki | F01L 13/06 123/321 |
| 2015/0159521 | A1* | 6/2015 | Baltrucki | F01L 1/24 123/90.12 |
| 2016/0017764 | A1 | 1/2016 | Baltrucki et al. | |
| 2016/0006229 | A1 | 3/2016 | Baltrucki et al. | |
| 2018/0347412 | A1 | 12/2018 | Hayman et al. | |
| 2020/0001243 | A1 | 1/2020 | Baltrucki et al. | |
| 2021/0047947 | A1* | 2/2021 | Van Wingerden | F01L 1/267 |
| 2021/0131318 | A1* | 5/2021 | Vanwingerden | F01L 1/18 |
| 2021/0277807 | A1* | 9/2021 | Cecur | F01L 13/06 |

FOREIGN PATENT DOCUMENTS

| | | | |
|---|---|---|---|
| WO | 2020011400 | A1 | 1/2020 |
| WO | 2020253993 | A1 | 12/2020 |

OTHER PUBLICATIONS

International Search Report for International App. No. PCT/IB2022/055218 dated Sep. 5, 2022, 3 pages.

Written Opinion of the International Search Authority for International App. No. PCT/IB2022/055218 dated Sep. 5, 2022, 3 pages.

* cited by examiner

VALVE ACTUATION SYSTEM COMPRISING IN-SERIES LOST MOTION COMPONENTS DEPLOYED IN A PRE-ROCKER ARM VALVE TRAIN COMPONENT AND VALVE BRIDGE

CROSS-REFERENCE TO RELATED APPLICATION

The instant application is a continuation-in-part of co-pending U.S. patent application Ser. No. 17/247,481, filed Dec. 12, 2020 and entitled "VALVE ACTUATION SYSTEM COMPRISING IN-SERIES LOST MOTION COMPONENTS FOR USE IN CYLINDER DEACTIVATION AND AUXILIARY VALVE ACTUATIONS," which prior application claims the benefit of Provisional U.S. Patent Application No. 62/948,107, filed Dec. 13, 2019 and entitled "VALVE ACTUATION SYSTEM COMPRISING IN-SERIES LOST MOTION COMPONENTS FOR USE IN CYLINDER DEACTIVATION AND AUXILIARY VALVE ACTUATIONS." The instant application additionally claims the benefit of Provisional U.S. Patent Application No. 63/202,255, filed Jun. 3, 2021 and entitled "VALVE ACTUATION SYSTEM COMPRISING IN-SERIES LOST MOTION BRIDGE BRAKE AND CYLINDER DEACTIVATION COMPONENT." The teachings of the above-listed prior applications are incorporated herein by this reference.

FIELD

The instant disclosure relates generally to valve actuation systems and, in particular, to a valve actuation system comprising lost motion components in series along a valve actuation load path, which valve actuation system may be used to implement both cylinder deactivation and auxiliary valve actuations.

BACKGROUND

Valve actuation systems for use in internal combustion engines are well known in the art. During positive power operation of an internal combustion engine, such valve actuation systems are used to provide so-called main valve actuation motions to engine valves, in conjunction with the combustion of fuel, such that the engine outputs power that may be used, for example, to operate a vehicle. Alternatively, valve actuation systems may be operated to provide so-called auxiliary valve actuation motions other than or in addition to the main valve actuation motions. Valve actuation systems may also be operated in a manner so as to cease operation of a given engine cylinder altogether, i.e., no operation in either main or auxiliary modes of operation through elimination of any engine valve actuations, often referred to as cylinder deactivation. As further known in the art, these various modes of operation may be combined to provide to provide desirable benefits. For example, future emissions standards for heavy duty diesel trucks require a technology that improves fuel economy and reduces emissions output. A leading technology that provides both at the same time is cylinder deactivation. It is well documented that cylinder deactivation reduces fuel consumption and increase temperatures that provide for improved aftertreatment emissions control.

A known system for cylinder deactivation is described in U.S. Pat. No. 9,790,824, which describes a hydraulically-controlled lost motion mechanism disposed in a valve bridge, an example of which is illustrated in FIG. 11 of the '824 patent and reproduced herein as FIG. 1. As shown in FIG. 1, the lost motion mechanism comprises an outer plunger 120 disposed with a bore 112 formed in the body 110 of a valve bridge 100. Locking elements in the form of wedges 180 are provided, which wedges are configured to engage with an annular outer recess 172 formed in a surface defining the bore 112. In the absence of hydraulic control applied to an inner plunger 160 (via, in this case, a rocker arm, not shown), an inner piston spring 144 biases the inner plunger 160 into position such that the wedges 180 extend out of openings formed in the outer plunger 120, thereby engaging the outer recess 172 and effectively locking the outer plunger 120 in place relative to the valve bridge body 110. In this state, any valve actuation motions (whether main or auxiliary motions) applied to the valve bridge via the outer plunger 120 are conveyed to the valve bridge body 110 and ultimately to the engine valves (not shown). However, provision of sufficiently pressurized hydraulic fluid to the top of the inner plunger 160 causes the inner plunger 160 to slide downward such that the wedges 180 are permitted to retract and disengage from the outer recess 172, thereby effectively unlocking the outer plunger 120 relative to the valve bridge body 110 and permitting the outer plunger 120 to slide freely within its bore 112, subject to a bias provided by an outer plunger spring 146 toward the rocker arm. In this state, any valve actuation motions applied to the outer plunger 120 will cause the outer plunger 120 to reciprocate in its bore 112. In this manner, and presuming the travel of the outer plunger 120 within its bore 112 is greater than the maximum extent of any applied valve actuation motions, such valve actuation motions are not conveyed to the engine valves and are effectively lost such that the corresponding cylinder is deactivated.

One drawback of deactivating cylinders, however, is that the flow of air mass through the engine is reduced, therefore also reducing the energy in the exhaust system. During vehicle warmup from a cold start, it is important to have an elevated exhaust temperature to rapidly raise the catalyst temperature to an efficient operating temperature. While cylinder deactivation provides an elevated temperature, the noted reduction in air mass flow is ineffective for a fast warmup.

To overcome this shortcoming of cylinder deactivation and provide fast warm up, one proven technology is to advance opening of the exhaust valve to release added thermal energy to the exhaust system, referred to as early exhaust valve opening (EEVO), which is a specific type of auxiliary valve actuation motion in addition to main valve events. In practice, such a system is based on the principle of adding valve actuation motions that are otherwise lost during main valve actuation to provide this early opening event. A system that combines both early exhaust opening and cylinder deactivation capability could meet the warmup requirements, and provide reduced emissions and improved fuel consumption.

A valve actuation system for providing EEVO may be provided using a rocker arm having a hydraulically-controlled lost motion component in the form of an actuator, such as that illustrated in U.S. Pat. No. 6,450,144, an example of which is illustrated in FIG. 19 of the '824 patent and reproduced herein as FIG. 2. In this system, a rocker arm 200 is provide having an actuator piston 210 disposed in a motion imparting end of the rocker am 200. The actuator piston 210 is biased out of its bore by a spring 217 such that the actuator piston 210 continuously contacts the corresponding engine valve (or valve bridge). Hydraulic passages 231, 236 are provided such that hydraulic fluid can be provided by a control passage 211 to fill the actuator piston bore. In these circumstances, the hydraulic fluid is retained in the bore by virtue of a check valve 241 and as long as the hydraulic passage 236 is not aligned with the control passage 211, in which case the actuator piston 210 is rigidly maintained in an extended position and unable to reciprocate within its bore. On the other hand, when the bore is not filled with hydraulic fluid (or such fluid is evacuated upon alignment of the noted passages 236, 211), the actuator piston 210 is free to reciprocate within its bore to the extent permitted by a lash adjusting screw 204. In such a system, a cam comprises cam lobes for providing both main and auxiliary valve actuation motions. In main valve actuation operation, no hydraulic fluid is provided to the actuator piston 210 such that the actuator piston 210 is permitted to reciprocate within its bore. In this case, so long as the permitted travel of actuator piston 210 into its bore is at least as large as the maximum motion provided by the EEVO lobe, but less than the maximum motion provided by the main event lobe, any valve actuation motions provided by the EEVO lobe will be lost through reciprocation of the actuation piston 210, but main event valve actuations will cause the actuation piston 210 to bottom out within its bore (or through solid contact with some other surface) and thereby convey the main event motion. On the other hand, when the actuator piston is hydraulically-locked in its extended position, the EEVO motions are not lost and are conveyed to the engine valve, though position-based evacuation of the actuator bore (i.e., resetting through alignment of the noted passages 236, 211) prevents over-extension of the engine valve during the main valve event motion.

It should be at least theoretically possible to combine lost motion-based cylinder deactivation and auxiliary valve actuation motion systems of the types described above to provide the desired cylinder deactivation and EEVO operation. However, it is not a given that simply directly combining such systems will provide the desired results.

For example, as described above, EEVO lost motion combines a normal main event lift with an early raised portion on the same camshaft. An example of this is illustrated in FIG. 3. In FIG. 3, a first curve 310 illustrates an idealized version of a main event valve lift that, in this example, has a maximum lift of approximately 14 millimeters. A second curve 311 illustrates a typical actual main event as experienced by the engine valve, which would occur when any EEVO motion provided by the cam is lost, e.g., the above-described rocker arm actuator in FIG. 2 is permitted to reciprocate. The upper, dashed curve 312 illustrates idealized valve lift if all valve actuation motions provided by the EEVO-capable cam are provided, e.g., when the rocker arm actuator is fully extended. As shown, the idealized lift 312 includes an EEVO event 313 of approximately 3 mm of valve lift during valve opening that, in practice, translates to approximately 2 millimeters of valve lift 314. The example illustrated in FIG. 3 also shows occurrence of resetting, whereby the actuator piston is allowed to collapse (i.e., the locked hydraulic fluid in the actuator bore is vented for this cycle of the engine valve), in this example, at approximately 10 mm of lift, thereby causing the normal-lift main event 311 to occur. The combination of these two lift events (as illustrated by the idealized lift profile 312) results in a total stroke of approximately 17 mm and would place, when being lost by the lost motion mechanism illustrated in FIG. 1, relatively high stresses on the outer plunger spring 146 as it attempts to bias the outer plunger 120 throughout the full 17 mm of travel of the outer plunger 120.

As an additional example, it is known that, during cylinder deactivation as described above, the usual force applied by the engine valve springs to bias the rocker arm into continuous contact with a valve actuation motion source (e.g., a cam) is no longer provided. While the outer piston plunger spring 146 provides some force back toward the rocker arm via the outer plunger 120, this force is relatively small and inadequate to control the rocker arm as needed. Thus, a separate rocker arm biasing element is typically provided to bias the rocker arm into contact with the cam, e.g., by applying a biasing force on the motion receiving end of the rocker arm toward the cam via a spring located over the rocker arm. Failure to adequately control the inertia presented by the rocker arm (due to the valve actuation motions that are still applied to the rocker arm despite deactivation) could lead to separation between the rocker arm and cam that, in turn, could lead to damaging impacts between the two. Similarly, the EEVO valve actuation motions that are otherwise lost when EEVO operation is not required still impart inertia to the rocker arm that must be similarly controlled. A complicating factor to such operation by the rocker arm biasing element is that each of these operations—cylinder deactivation and EEVO—typically occur at significantly different ranges of speed.

Normally, cylinder deactivation typically occurs at engine speeds no greater than approximately 1800 rpm and the rocker arm biasing element is configured to provide sufficient force at these speeds to ensure proper contact between the rocker arm and cam. On the other hand, otherwise lost EEVO valve actuation motions will be present even up to high engine speeds (e.g., on the order of 2600 rpm). Thus, to obtain the benefits of combined cylinder deactivation and EEVO operation, the rocker arm biasing element would need to accommodate the higher speed at which EEVO valve actuation motions may still be applied to the rocker arm. Due to the comparatively high speed at which they may still occur, rocker arm control for lost EEVO valve actuation motions requires application of a high force by the rocker arm biasing element. However, this occurs at a small valve lift where the rocker arm bias spring has its lowest preload. On the other hand, cylinder deactivation normally occurs at a lower speed, and throughout a higher lift portion (main valve actuation motions) where the rocker arm biasing element is at an increased preload. However, the challenge of providing a rocker arm biasing element that is capable of both providing a high force at lowest preload (as required by EEVO) and surviving the stresses required during full travel (as required by cylinder deactivation) is difficult to overcome.

SUMMARY

The above-noted shortcomings of prior art solutions are addressed through the provision of a valve actuation system for actuating at least one engine valve in accordance with the instant disclosure. In particular, the valve actuation system comprises a valve actuation motion source configured to provide a main valve actuation motion and an auxiliary valve actuation motion for actuating the at least one engine valve via a valve actuation load path. A lost motion subtracting mechanism is arranged in pre-rocker arm valve train component and configured, in a first default operating state, to convey at least the main valve actuation motion and configured, in a first activated state, to lose the main valve actuation motion and the auxiliary valve actuation motion. Additionally, a lost motion adding mechanism is arranged in a valve bridge and configured, in a second default operating state, to lose the auxiliary valve actuation motion and configured, in a second activated state, to convey the auxiliary valve actuation motion, wherein the lost motion adding mechanism is in series with the lost motion subtracting mechanism in the valve actuation load path.

Examples of auxiliary valve actuation motions include at least one of an early exhaust valve opening valve actuation motion, a late intake valve closing valve actuation motion or an engine braking valve actuation motion.

In one embodiment, the valve actuation system further includes an engine controller configured to operate the internal combustion engine using the lost motion subtracting mechanism and the lost motion adding mechanism. In a positive power mode, the engine controller controls the lost motion subtracting mechanism to operate in the first default operating state and the lost motion adding mechanism to operate in the second default operating state. In a deactivated mode, the engine controller controls the lost motion subtracting mechanism to operate in the first activated operating state and the lost motion adding mechanism to operate in the second default operating state. In an auxiliary mode, the engine controller controls the lost motion subtracting mechanism to operate in the first default operating state and the lost motion adding mechanism to operate in the second activated operating state.

A corresponding method is also disclosed.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 4:
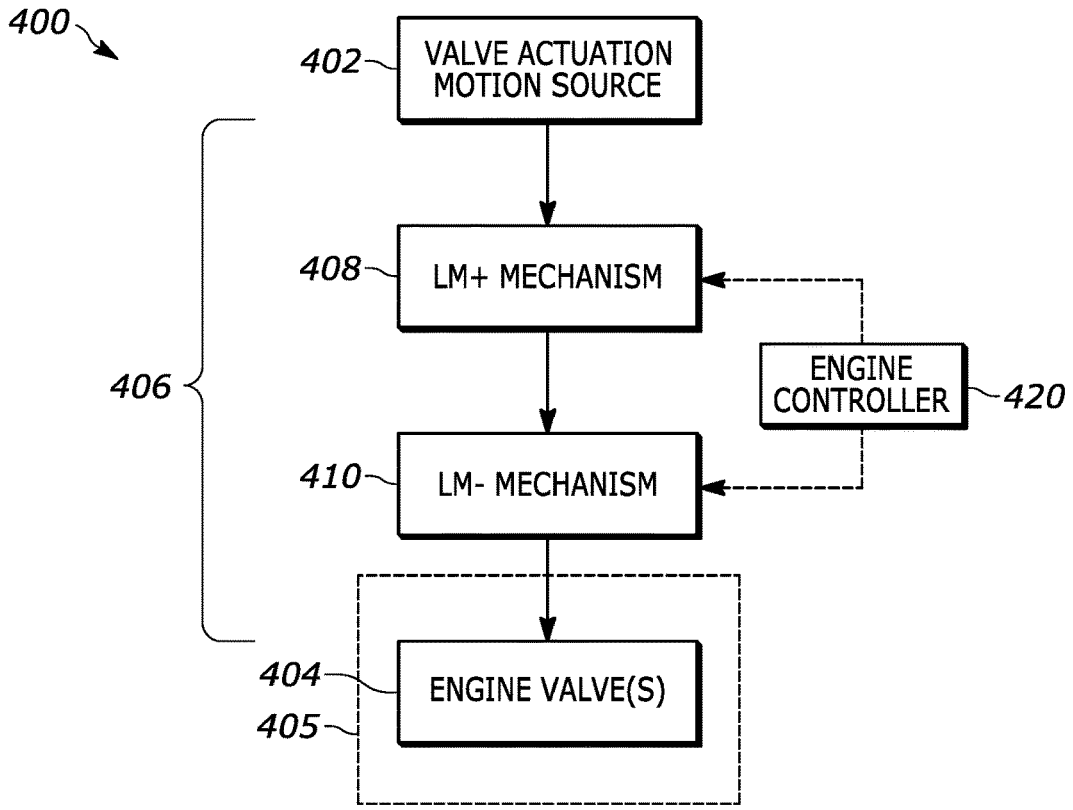
FIGS. 4 and 5 are schematic illustrations of embodiments of a valve actuation system in accordance with the instant disclosure.

FIG. 4 schematically illustrates a valve actuation system 400 in accordance with the instant disclosure. In particular, the valve actuation system 400 comprises a valve actuation motion source 402 that serves as the sole source of valve actuation motions (i.e., valve opening and closing motions) to one or more engine valves 404 via a valve actuation load path 406. The one or more engine valves 404 are associated with a cylinder 405 of an internal combustion engine. As known in the art, each cylinder 405 typically has at least one valve actuation motion source 402 uniquely corresponding thereto for actuation of the corresponding engine valve(s) 404. Further, although only a single cylinder 405 is illustrated in FIG. 4, it is appreciated that an internal combustion engine may comprise, and often does, more than one cylinder and the valve actuation systems described herein are applicable to any number of cylinders for a given internal combustion engine.

The valve actuation motion source 402 may comprise any combination of known elements capable of providing valve actuation motions, such as a cam. The valve actuation motion source 110 may be dedicated to providing exhaust motions, intake motions, auxiliary motions or a combination of exhaust or intake motions together with auxiliary motions. For example, in a presently preferred embodiment, the valve actuation motion source 402 may comprise a single cam configured to provide a main valve actuation motion (exhaust or intake) and at least one auxiliary valve actuation motion. As a further example, in the case where the main valve actuation motion comprises a main exhaust valve actuation motion, the at least one auxiliary valve actuation motion may comprise an EEVO valve event and/or a compression-release engine braking valve event. As yet a further example, in the case where the main valve actuation motion comprises a main intake valve actuation motion, the at least one auxiliary valve actuation motion may comprise a late intake valve closing (LIVC) valve event. Sill further types of auxiliary valve actuation motions that may be combined on a single cam with a main valve actuation motion may be known to those skilled in the art, and the instant disclosure is not limited in this regard.

The valve actuation load path 406 comprises any one or more components deployed between the valve actuation motion source 402 and the at least one engine valve 404 and used to convey motions provided by the valve actuation motion source 402 to the at least one engine valve 404, e.g., tappets, pushrods, rocker arms, valve bridges, automatic lash adjusters, etc. Further, as shown, the valve actuation load path 406 also includes a lost motion adding (LM+) mechanism 408 and a lost motion subtracting (LM−) mechanism 410. As used herein, an LM+ mechanism is a mechanism that defaults to or is "normally" in a state (i.e., when a controlling input is not asserted) in which the mechanism does not convey any auxiliary valve actuation motions applied thereto and may or may not convey any main valve actuation motions applied thereto. On the other hand, when an LM+ mechanism is in an activated state (i.e., when a controlling input is asserted), the mechanism does convey any auxiliary valve actuation motions applied thereto and also conveys any main valve actuation motions applied thereto. Furthermore, As used herein, an LM− mechanism is a mechanism that defaults to or is "normally" in a state (i.e., when a controlling input is not asserted) in which the mechanism does convey any main valve actuation motions applied thereto and may or may not convey any auxiliary valve actuation motions applied thereto. On the other hand, when an LM− mechanism is in an activated state (i.e., when a controlling input is asserted), the mechanism does not convey any valve actuation motions applied thereto, whether main or auxiliary valve actuation motions. In short, an LM+ mechanism, when activated, is capable of adding or including valve actuation motions relative to its default or normal operating state, whereas an LM− mechanism, when activated, is capable of subtracting or losing valve actuation motions relative to its default or normal operating state.

Figure 1:
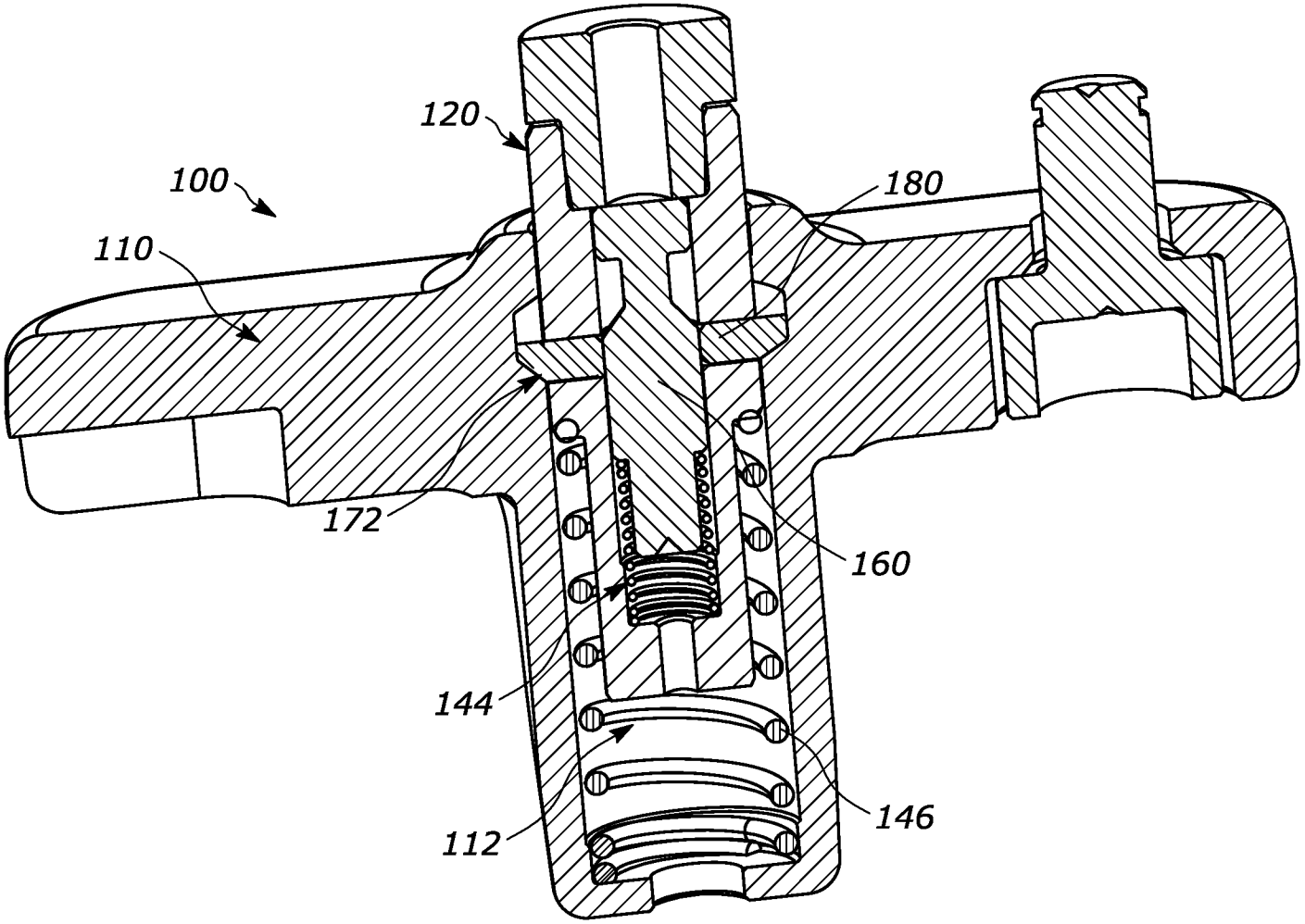
(PRIOR ART) FIG. 1
FIG. 1 illustrates a lost motion mechanism suitable for providing cylinder deactivation in accordance with prior art techniques.

Various types of lost motion mechanisms that may serve as LM+ or LM− mechanisms are well known in the art, including hydraulically- or mechanically-based lost motion mechanisms that may be hydraulically-, pneumatically-, or electromagnetically-actuated. For example, the lost motion mechanism depicted in FIG. 1 and taught in U.S. Pat. No. 9,790,824 (the teachings of which are incorporated herein by this reference), is an example of a mechanically locking LM− mechanism that is hydraulically-controlled. As described above, in the absence of hydraulic fluid input to the inner plunger 160 (i.e., in the default state), the locking elements 180 are received in the outer recess 772 thereby "locking" the outer plunger 120 to the body 120 such that actuation motions applied thereto are conveyed. On the other hand, when hydraulic fluid input is provided to the inner plunger 160 (i.e., in the activated state), the locking elements 180 are permitted to retract thereby "unlocking" the outer plunger 120 from the body 120 such that actuation motions applied thereto are not conveyed or lost. As another example, the lost motion mechanism depicted in FIG. 2 and taught in U.S. Pat. No. 6,450,144 (the teachings of which are incorporated herein by this reference), is an example of a hydraulically-based LM+ mechanism that is hydraulically-controlled. As described above, in the absence of hydraulic fluid input to the passages 231, 236 (i.e., in the default state), the actuator piston 210 is free to reciprocate in its bore such that any actuation motions applied thereto that are lesser in magnitude than the maximum distance that the actuator piston 210 can retract into its bore (the actuator piston stroke length) are not conveyed or lost, whereas any actuation motions applied thereto that are greater than the actuator piston stroke length are conveyed.

As further depicted in FIG. 4, an engine controller 420 may be provided and operatively connected to the LM+ and LM− mechanisms 408, 410. The engine controller 420 may comprise any electronic, mechanical, hydraulic, electrohydraulic, or other type of control device for controlling operation of the LM+ and LM− mechanisms 408, 410, i.e., switching between their respective default and activated operating states as described above. For example, the engine controller 420 may be implemented by a microprocessor and corresponding memory storing executable instructions used to implement the required control functions, including those described below, as known in the art. It is appreciated that other functionally equivalent implementations of the engine controller 130, e.g., a suitable programmed application specific integrated circuit (ASIC) or the like, may be equally employed. Further, the engine controller 420 may include peripheral devices, intermediate to engine controller 420 and the LM+ and LM− mechanisms 408, 410, that allow the engine controller 420 to effectuate control over the operating state of the LM+ and LM− mechanisms 408, 410. For example, where the LM+ and LM− mechanisms 408, 410 are both hydraulically-controlled mechanisms (i.e., responsive to the absence or application of hydraulic fluid to an input), such peripheral devices may include suitable solenoids, as known in the art.

Figure 5:
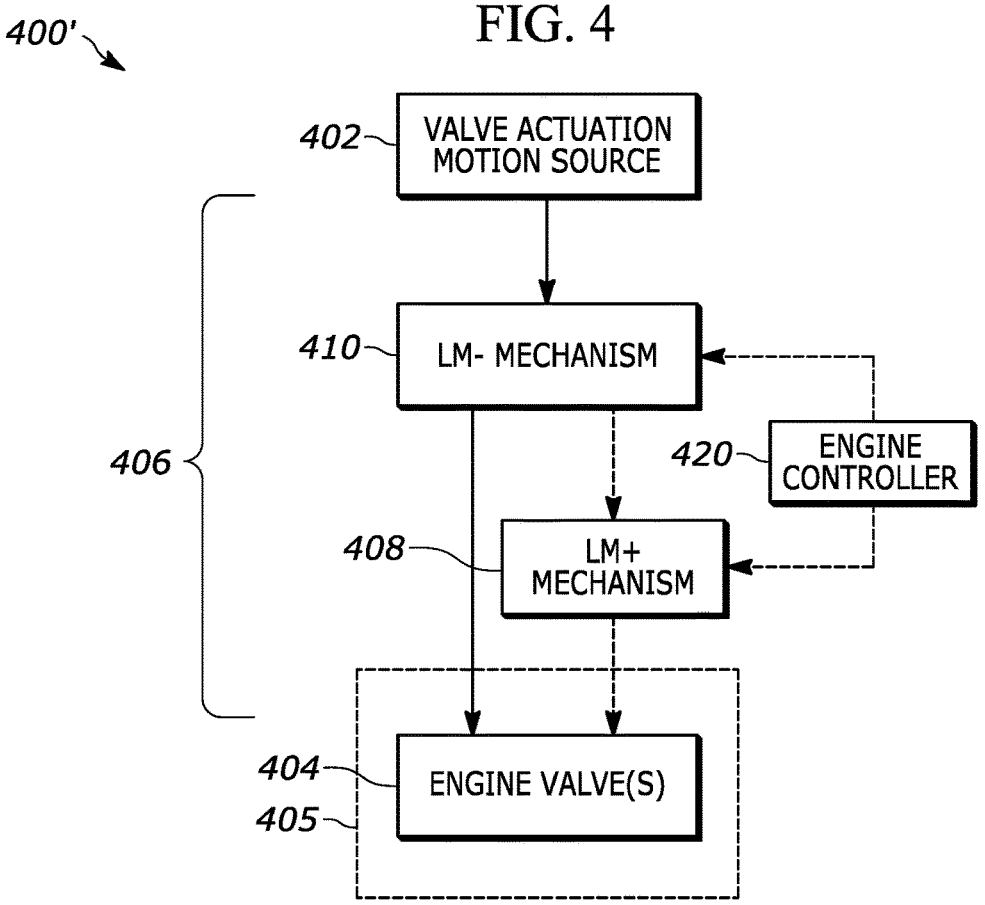
Figure 15:
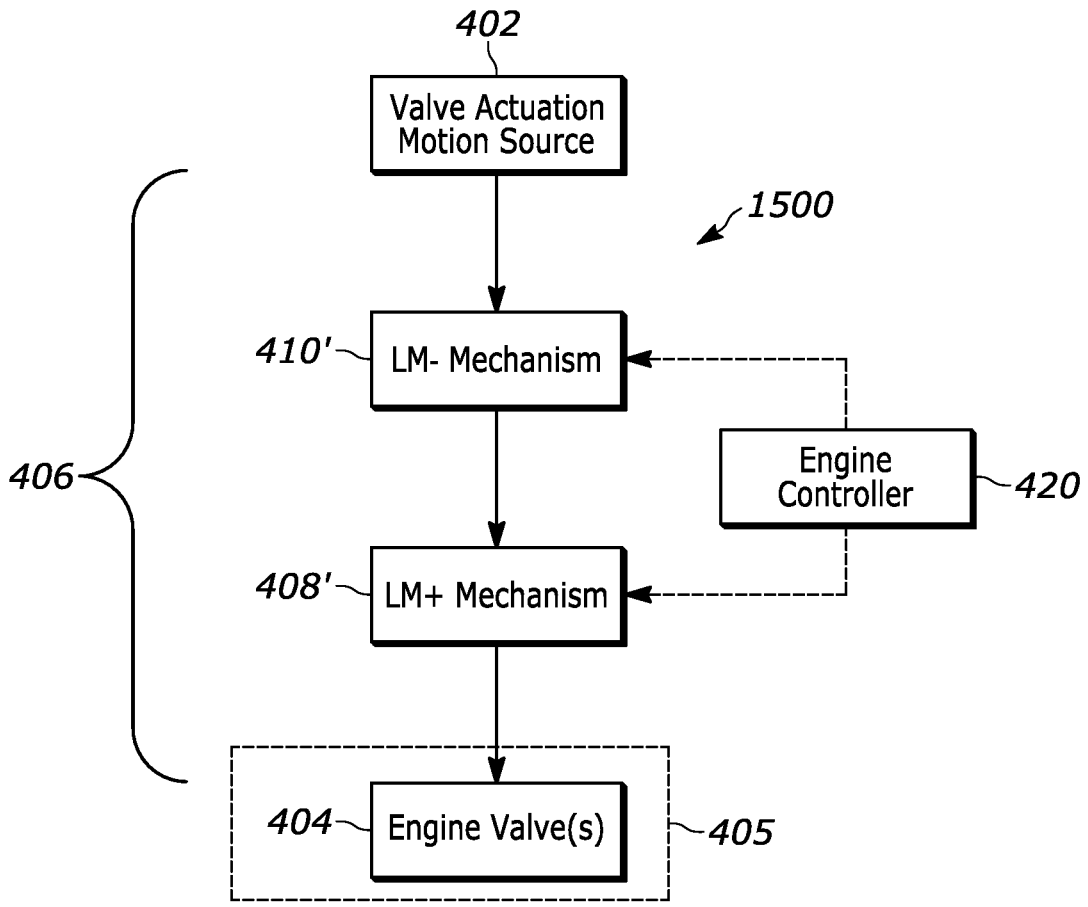
FIG. 15 is a schematic illustration of an embodiment of a valve actuation system in accordance with a variation of the valve actuation system depicted in FIG. 4 and in accordance with the instant disclosure.

In the system 400 illustrated in FIG. 4, the LM+ mechanism 408 is arranged closer along the valve actuation load path 406 to the valve actuation motion source than the LM− mechanism 410. An example of such a system is described in further detail below with reference to FIGS. 6-12. However, this is not a requirement. For example, FIGS. 5 and 15 illustrate valve actuation systems 400', 1500 in which like reference numerals refer to like elements as compared to FIG. 4, where the LM− mechanism 410, 410' is arranged closer to the valve actuation motion source 402 than the LM+ mechanism 408, 408'. Examples of the system of FIG. 5 are described in further detail below with reference to FIGS. 12 and 13, and an example of the system of FIG. 15 is described in further detail below with reference to FIGS. 16-18.

Referring again to FIG. 4, the LM+ mechanism 408 is in series along the valve actuation load path 406 with the LM− mechanism 410 in all operating states of the LM+ mechanism 408. That is, whether the LM+ mechanism 408 is in its default state or in its activated state as described above, any main valve actuation motions provided by the valve actuation motion source 402 are conveyed by the LM+ mechanism 408 to the LM− mechanism 410. However, once again, this is not a requirement, as illustrated in FIG. 5 where the LM+ mechanism 408 is illustrated either in series or not in series with the LM− mechanism 410 as a function of the operating state of the LM+ mechanism 408. In this case, when the LM+ mechanism 408 is in its default operating state, i.e., when it is controlled to lose any auxiliary valve actuation motions applied thereto, the LM+ mechanism 408 plays no role in conveying main valve actuation motions conveyed by the LM− mechanism 410; this is illustrated by the solid arrow between the LM− mechanism 410 and the engine valve(s) 404. In effect, in this state, the LM+ mechanism 408 is removed from the valve actuation load path 406 as depicted in FIG. 5. On the other hand, when the LM+ mechanism 408 is in its activated operating state, i.e., when it is controlled to convey any auxiliary valve actuation motions applied thereto, the LM+ mechanism 408 participates in the conveyance of both the main valve actuation motions and the auxiliary valve actuation motions that are received from the LM-mechanism 410, thereby effectively placing the LM+ mechanism 408 in series therewith; this is illustrated by the dashed arrows between the LM− mechanism 410 and the LM+ mechanism 408, and the LM+ mechanism 408 and the engine valve(s) 404.

Figure 14:
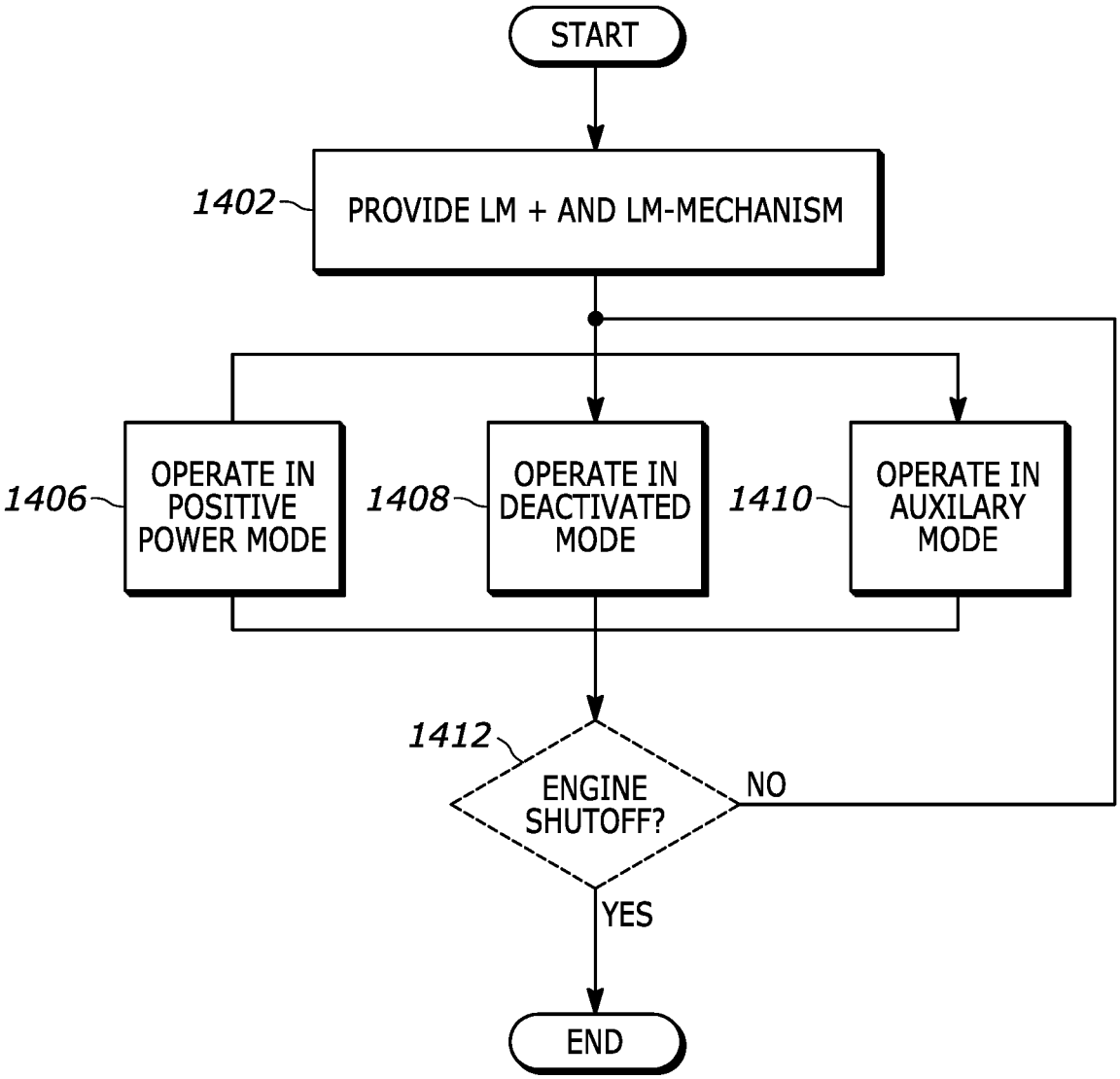
FIG. 14 is a flowchart illustrating a method of operating an internal combustion engine in accordance with the instant disclosure.

The valve actuation systems 400, 400' of FIGS. 4 and 5 facilitate operation of the cylinder 405, and consequently the internal combustion engine, in a positive power mode, a deactivated mode or an auxiliary mode in systems having a single valve actuation motions source 402 providing all valve actuation motions to the engine valve(s) 404. This is further described with reference to the method illustrated in FIG. 14. At block 1402, LM+ and LM− mechanisms, as described above, are arranged in a valve actuation load path.

In particular, the LM− mechanism is configured, in a first default operating state, to convey at least main valve actuation motions applied thereto and configured, in a first activated state, to lose any main valve actuation motion and the auxiliary valve actuation motion applied thereto. Additionally, the LM+ mechanism is configured, in a second default operating state, to lose any auxiliary valve actuation motions applied thereto and configured, in a second activated state, to convey the auxiliary valve actuation motion, wherein the LM+ mechanism is in series with the LM− mechanism in the valve actuation load path at least during the second activated state.

Having provisioned a valve actuation system at step 1402, processing proceeds at any of blocks 1406-1410, where engine is respectively operated in a positive power mode, a deactivated mode or an auxiliary mode based on control of the operating states of the LM+ and LM-mechanisms. Thus, at block 1406, in order to operate the engine in the positive power mode, the LM− mechanism is placed in its first default operating state and the LM+ mechanism is placed in its second default operating state. In this mode, then, the LM+ mechanism will not convey any auxiliary valve actuation motions but may convey any main valve actuation motions (depending on whether the LM+ mechanism is arranged as in FIG. 4 or FIG. 5) that are conveyed by the LM-mechanism. The net effect of this configuration is that only main valve actuation motions are conveyed to the engine valve(s), as required for positive power operation.

At block 1408, in order to operate the engine in the deactivated mode, the LM− mechanism is placed in its first activated operating state and the lost motion adding mechanism is in its second default operating state. In this mode, then, the LM− mechanism will not convey any valve actuation motions applied thereto. As a result, the corresponding cylinder will be deactivated to the extent that no valve actuation motions will be conveyed to the engine valve(s). Given this operation of the LM− mechanism, the operating state of the LM+ mechanism will have no effect on the engine valve(s). However, in a presently preferred embodiment, during deactivated mode operation, the LM+ mechanism placed in its second default operating state.

At block 1410, in order to operate the engine in the auxiliary mode, the LM− mechanism is placed in its first default operating state and the LM+ mechanism is placed in its second activated operating state. In this mode, then, the LM+ mechanism will convey any auxiliary valve actuation motions and any main valve actuation motions that are conveyed by the LM− mechanism. The net effect of this configuration is that both main valve actuation motions and auxiliary valve actuation motions are conveyed to the engine valve(s), thereby providing for whatever auxiliary operation is provided by the particular auxiliary valve actuation motions, e.g., EEVO, LIVC, compression-release engine braking, etc.

Operation of the engine between any of the various modes provided at steps 1406-1410 may continue for as long as the engine is running, as illustrated by block 1412.

Figure 6:
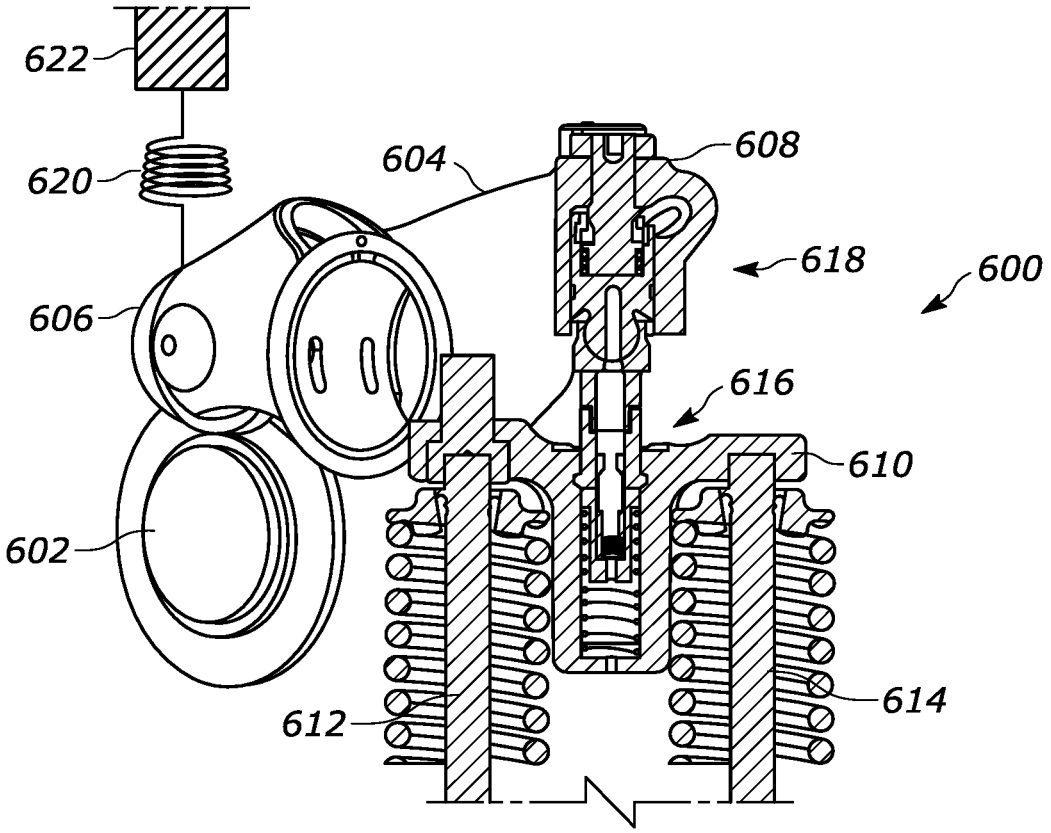
FIG. 6 illustrates a partial cross-sectional view of an embodiment of a valve actuation system in accordance with embodiment of FIG. 4.

FIG. 6 illustrates a partial cross-sectional view of a valve actuation system 600 in accordance with the embodiment of FIG. 4. In particular, the system 600 comprises a valve actuation motion source 602 in the form of a cam operatively connected to a rocker arm 604 at a motion receiving end 606 of the rocker arm 604. A rocker arm biasing element 620 (e.g., a spring), reacting against a fixed surface 622, may be provided to assist in biasing the rocker arm 604 into contact with the valve actuation motion source 602. As known in the art, the rocker arm 604 rotationally reciprocates about a rocker shaft (not shown), thereby imparting valve actuation motions provided by the valve actuation motion source, via a motion imparting end 608 of the rocker arm 604, to a valve bridge 610. In turn, the valve bridge 610 is operatively connected to a pair of engine valves 612, 614. As further shown, the valve bridge 610 comprises a LM-mechanism 616 (locking piston) of the type illustrated and described in FIG. 1 above, whereas the rocker arm 604 includes a LM+ mechanism 618 (actuator) of the type substantially similar to that illustrated and described above relative to FIG. 2.

Figure 7:
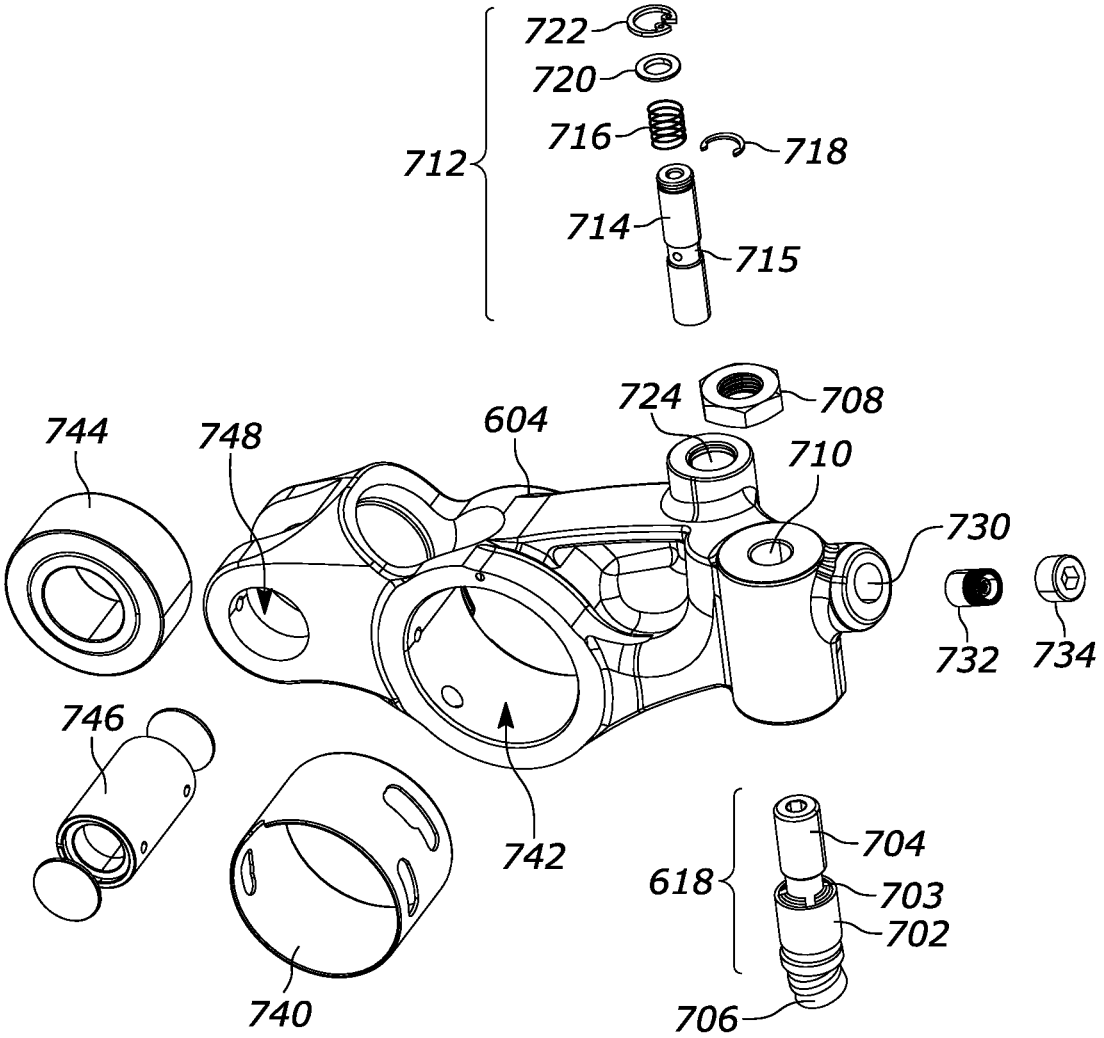
FIG. 7 is an exploded view of a resetting rocker arm in accordance with the embodiment of FIG. 6.
Figure 9:
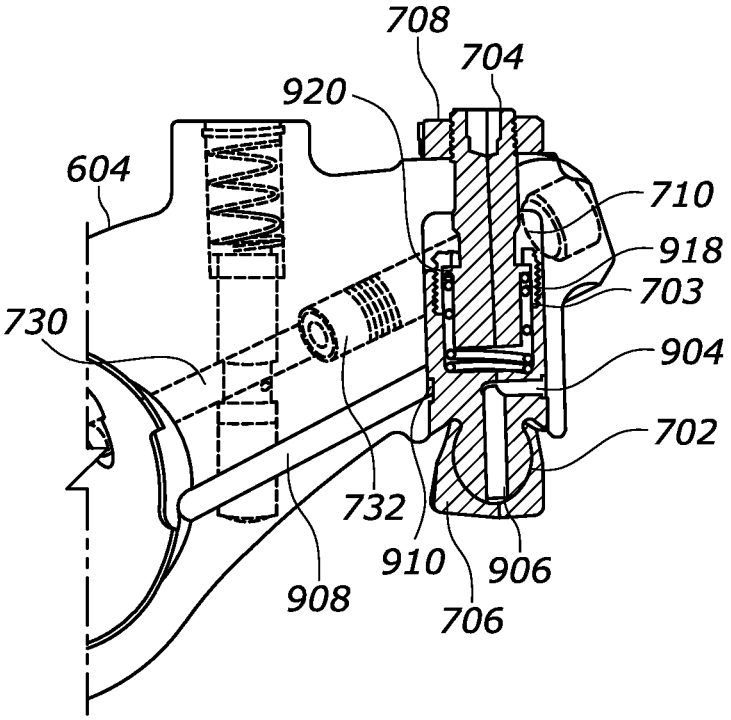

Details of the LM+ mechanism 618 are further illustrated in FIG. 7 along with other components arranged within the rocker arm 604. The LM+ mechanism 618 comprises an actuator piston 702 that is attached to a retainer 703 such that the actuator piston 702 is slidably arranged on a lash adjustment screw 704. Further details of the LM+ mechanism 618 are described with reference to FIG. 9 below. As best shown in FIG. 9, the lash adjustment screw 704 is threadedly fastened in an actuator piston bore 710 such that the LM+ mechanism 618 is arranged in a lower portion of the actuator piston bore 710. A locking nut 704 is provided to secure the lash adjustment screw 704 at its desired lash setting in use.

FIG. 7 also illustrates a resetting assembly 712 that is arranged within in a resetting assembly bore 724, which includes openings on the top and bottom (not shown) of the rocker arm 604. The resetting assembly 712 comprises a reset piston 714 slidably arranged within the resetting assembly bore 724. A resetting piston spring 715 is arranged above the resetting piston 714 and a lower end of the resetting piston spring 716 is secured to the resetting piston 714 using a c-clip 718 or other suitable component. A washer 720 is arranged at an upper end of the resetting piston spring 716. The resetting assembly 712 is maintained in the resetting assembly bore 724 by a spring clip 722, as known in the art. As described in further detail below relative to FIGS. 10 and 11, the resetting piston spring 716 biases the resetting piston 714 out of the lower opening of the resetting assembly bore 724 such that the resetting piston 714 is capable of contacting a fixed surface (not shown in FIG. 7). As the rocker arm 604 reciprocates, the resetting piston 714 slides within the resetting assembly bore 724 in a controllable fashion dictated by rotation of the rocker arm 604. In particular, at a desired position of the rocker arm 604, the resetting piston 714 may be configured such that an annular channel 715 formed in the resetting piston registers with a resetting passage 802 (FIG. 8) to effectuate a reset of the LM+ mechanism 618, as described in further detail below.

FIG. 7 further illustrates an upper hydraulic passage 730 formed in the rocker arm 604 that receives a check valve 732. As described in greater detail below, the upper hydraulic passage 730 provides hydraulic fluid (provided by a suitable supply passage formed in a rocker shaft, not shown) to the actuator piston bore 710 to control operation of the LM+ mechanism 618. In order to ensure a fluid-tight seal on the upper hydraulic passage 730 following installation of the check valve 732, a threaded plug 734 or similar device may be employed. Additionally, for completeness, FIG. 7 also illustrates a rocker arm bushing 740 that may be inserted in a rocker shaft opening 742 and over a rocker shaft as known in the art. Additionally, a cam follower 744 may be mounted on a cam follower axle 746 arranged within a suitable opening 748.

Figure 2:
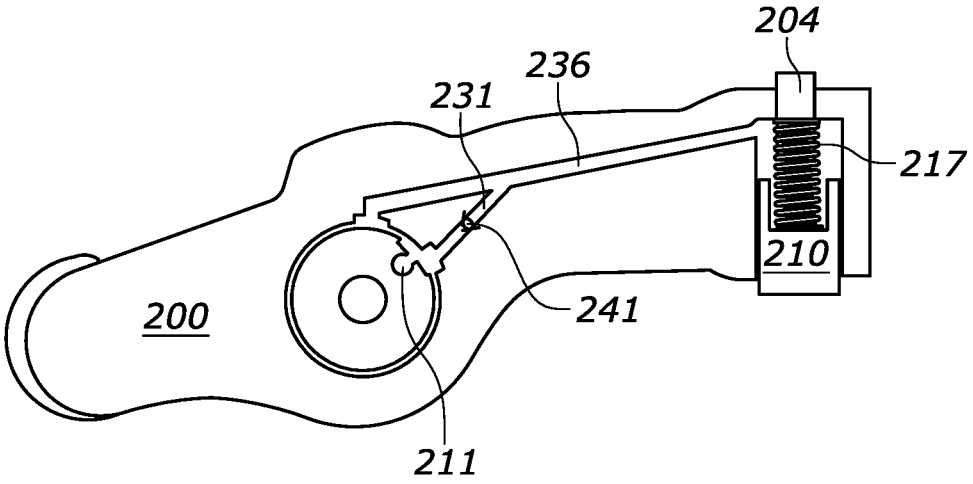
(PRIOR ART) FIG. 2
FIG. 2 illustrates a lost motion mechanism suitable for providing auxiliary valve actuation in accordance with prior art techniques.

Unlike the actuator piston 210 in FIG. 2, however, and as best illustrated in FIG. 9, the actuator piston 702 of the LM+ mechanism 618 includes hydraulic passages 904, 906 that permit hydraulic fluid to be supplied to the LM− mechanism 616 via the actuator piston 702. As shown in FIG. 9, a lower hydraulic passage 908 formed in the rocker arm 604 receives hydraulic fluid from a supply channel in the rocker shaft (not shown) and routes the hydraulic fluid to a lower portion of an actuator piston bore 710. The actuator piston 702 comprises an annular channel 910 formed in a sidewall surface thereof that registers with the hydraulic supply passage 908 throughout the entire stroke of the actuator piston 702. In turn, the annular channel 910 communicates with a horizontal passage 904 and a vertical passage 906 formed in the actuator piston 702. The vertical passage 906 directs hydraulic fluid to the swivel 706 having an opening formed therein for the passage of the hydraulic fluid to the LM− mechanism 616. In this manner, hydraulic fluid may be selectively supplied as a control input to the LM− mechanism 616.

As described above, and further shown in FIG. 9, the LM+ mechanism 618 comprises the lash adjustment screw 704 extending into the actuator piston bore 710. An actuator piston spring 918 is disposed between the lash adjustment screw 704 and the actuator piston 702 and abuts a lower surface of a shoulder 920 formed in the lash adjustment screw 704, thereby biasing the actuator piston 702 out of the actuator piston bore 710. In this embodiment, the actuator piston 702 is fastened via suitable threading to a retainer 703 that engages with an upper surface of the lash adjustment screw shoulder 920, thereby limiting the outward stroke of the actuator piston 702, as described in further detail below.

Figure 8:
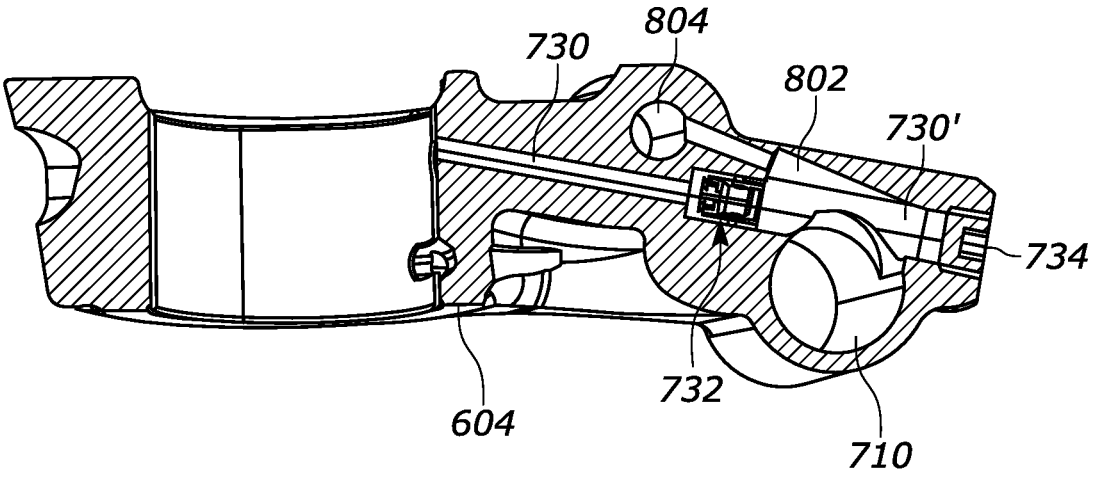
FIGS. 8-11 are respective partial top and side cross-sectional views of the resetting rocker arm in accordance with the embodiment of FIGS. 6-8.

FIGS. 8 and 9 further illustrate (in phantom in FIG. 9) the upper hydraulic passage 730 formed in the rocker arm 604 for selectively supplying hydraulic fluid (e.g., via a high speed solenoid, not shown) to the actuator piston bore 710 above the actuator piston 702. (Note that, in FIG. 8, the various components forming the LM+ mechanism 618 and the resetting assembly 712 are not shown for ease of illustration.) The check valve 732 is provided in a widened portion 730' of the upper hydraulic passage 730 to prevent back flow of hydraulic fluid from the actuator piston bore 710 back to the supply passage feeding the upper hydraulic passage 730. In this manner, and absent resetting of the LM+ mechanism 618 as described below, a high-pressure chamber in the actuator piston bore 710 may be formed between the check valve 732 and the actuator piston 702 such that a locked volume of hydraulic fluid maintains the actuator piston 702 in an extended (activated) state.

Figure 3:
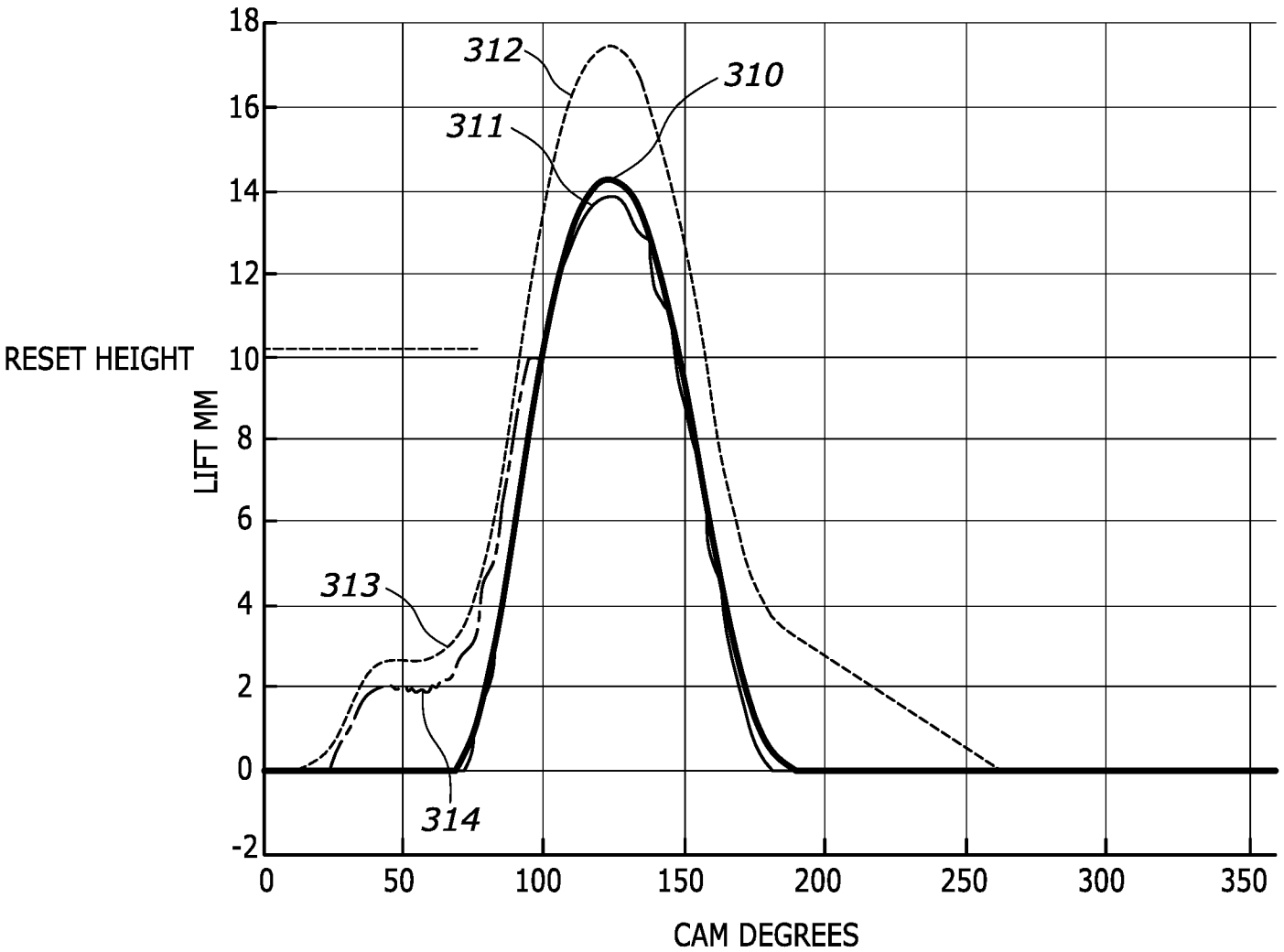
FIG. 3 is a graph illustrating an example of EEVO valve actuation motions in accordance with the instant disclosure.

As described above relative to FIG. 3, valve actuation systems in which a single valve actuation motion source provides both main and auxiliary valve actuation motions may require the ability to reset in order to avoid over-extension of the engine valve(s) during combined auxiliary and main valve actuation motions. In the context of the embodiment illustrated in FIGS. 6-11, venting of the locked volume of hydraulic fluid and reset of the actuator piston 702 is provided through operation of the resetting assembly 712. As best shown in FIG. 8, a resetting passage 802 is provided in fluid communication with that portion of the actuation piston bore 710 forming the high-pressure chamber with the actuator piston 702, and the resetting piston bore 804. The resetting piston 714 is effectively a spool valve having an end extending out of the bottom of the rocker arm 604 under bias of the resetting piston spring 716. In the embodiment illustrated in FIGS. 10 and 11, the resetting piston 714 is of sufficient length and the resetting piston spring 716 has sufficient stroke to ensure that the resetting piston 714 continuously contacts a fixed contact surface 1002 throughout all positions of the rocker arm 604.

Figure 10:
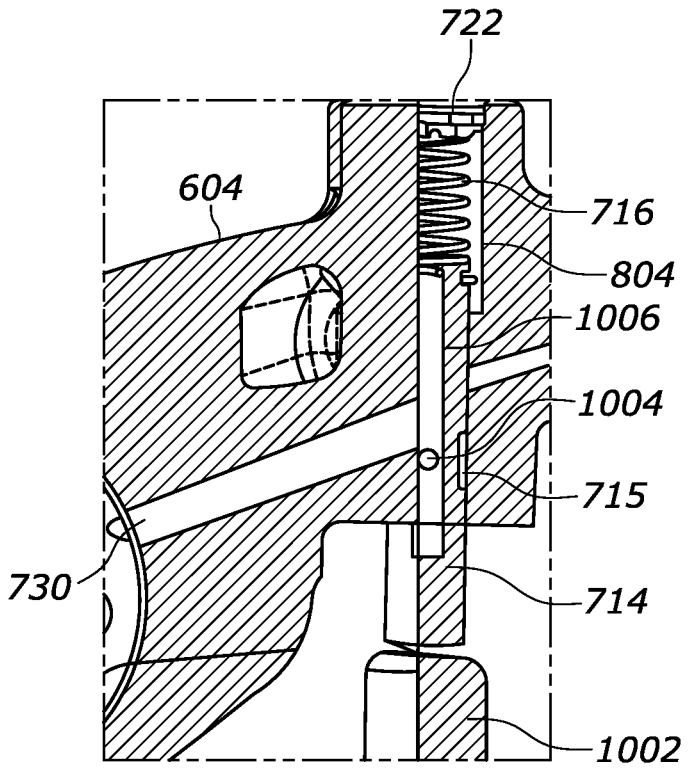
Figure 11:
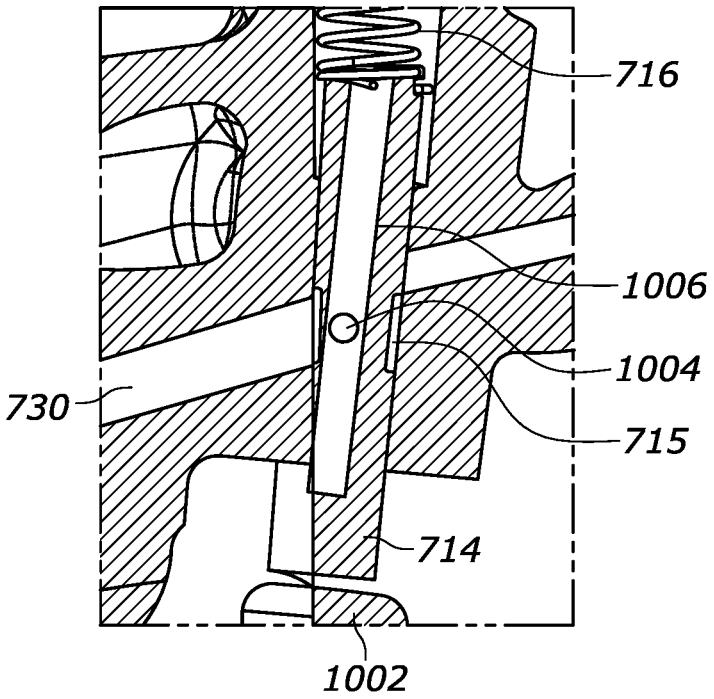

As shown in FIG. 10, the rocker arm 604 is at base circle relative to the cam 602 (i.e., rotated to the fullest extent toward the cam 602). In this state, as well as relatively low lifts (e.g., below the reset height shown in FIG. 3), the annular channel 715 is not aligned with the resetting passage 802 (hidden behind the upper hydraulic passage 730 as shown in FIGS. 10 and 11) such that an outer diameter of the resetting piston 714 seals off communication with resetting passage 802, thereby maintaining a trapped volume of fluid (when provided) in the actuator piston bore 710. As the rocker arm 604 rotates at higher valve lifts (e.g., at or above the reset height shown in FIG. 3) as shown in FIG. 11, the resetting piston 714 pivots about its contact point with the fixed surface 1002 and slides relative to the resetting piston bore 804 such that the annular channel 715 registers with the resetting passage 802, thereby permitting the trapped hydraulic fluid to flow through the annular channel 715, into a radial hole 1004 formed in the resetting piston 714 and vent through the top of an axial passage 1006 (shown in phantom) formed in the resetting piston 714. As the rocker arm 604 once again rotates back following the high lift event, as in FIG. 10, the resetting piston 714 translates in its bore 804 and once again seals off the resetting passage 802 thereby permitting refill of the actuator piston bore 710.

As noted above, the resetting assembly 712 illustrated in FIGS. 6-11 is configured to maintain constant contact with the fixed contact surface 1002. However, it is appreciated that this is not a requirement. For example, the resetting assembly could instead comprise a poppet-type valve that contacts a fixed surface only when the required reset height is achieved.

As noted previously, the rocker arm biasing element 620 may be provided to assist in biasing the rocker arm 604 into contact with the cam 602. A feature of the disclosed system 600 is that individually, neither the rocker arm biasing element 620 nor the actuator piston spring 918 is configured to individually provide sufficient force to bias the rocker arm 604 into contact with the cam 602 throughout substantially all operating conditions. However, the rocker arm biasing element 620 and the actuator piston spring 918, in this embodiment, are selected to work in combination for this purpose throughout substantially all operating conditions for the rocker arm 604. For example, to aid in biasing the rocker arm 604 towards the cam 602, the actuator piston spring 918 provide a high force only during relatively low lift valve actuation motions (e.g., EEVO, LIVC, etc.) where it is needed most due to potential high speed operation. If uncontrolled, the biasing force applied by the actuator piston spring 918 could cause the actuator piston 702 to push against the LM− mechanism 616 with significant force. Where the LM− mechanism 616 is a mechanical locking mechanism such as the described with reference to FIG. 1, such force could be strong enough to interfere with the ability of the locking elements 180 to extend and retract, and thereby prevent locking and unlocking of the LM− mechanism 616. The travel limit imposed by the lash adjustment screw shoulder 920 on the actuator piston 702 prevents such excessive loading on the LM− mechanism 616, thereby preserving normally-provided lash space within the LM− mechanism 616 that permits the locking elements 180 to freely extend/retract as needed.

Additionally, the extension of the actuator piston 702 by the actuator piston spring 918, though relatively small, nonetheless reduces the range stress that the outer plunger spring 146 will have to endure. In turn, the actuator piston spring 918 can be a high force, low travel spring that provides the high force that is particularly needed for low lift, potentially high speed valve actuation motions. This burden sharing by the actuator piston spring 918 and the outer plunger spring 146 could also alleviate the need for the rocker arm biasing element 620 to provide a high preload, and permits design of the rocker arm biasing element 620 to be focused on the lower speed, higher lift portion for the main valve actuation motions that occur during deactivated state operation, which is a less stringent design constraint.

Figure 12:
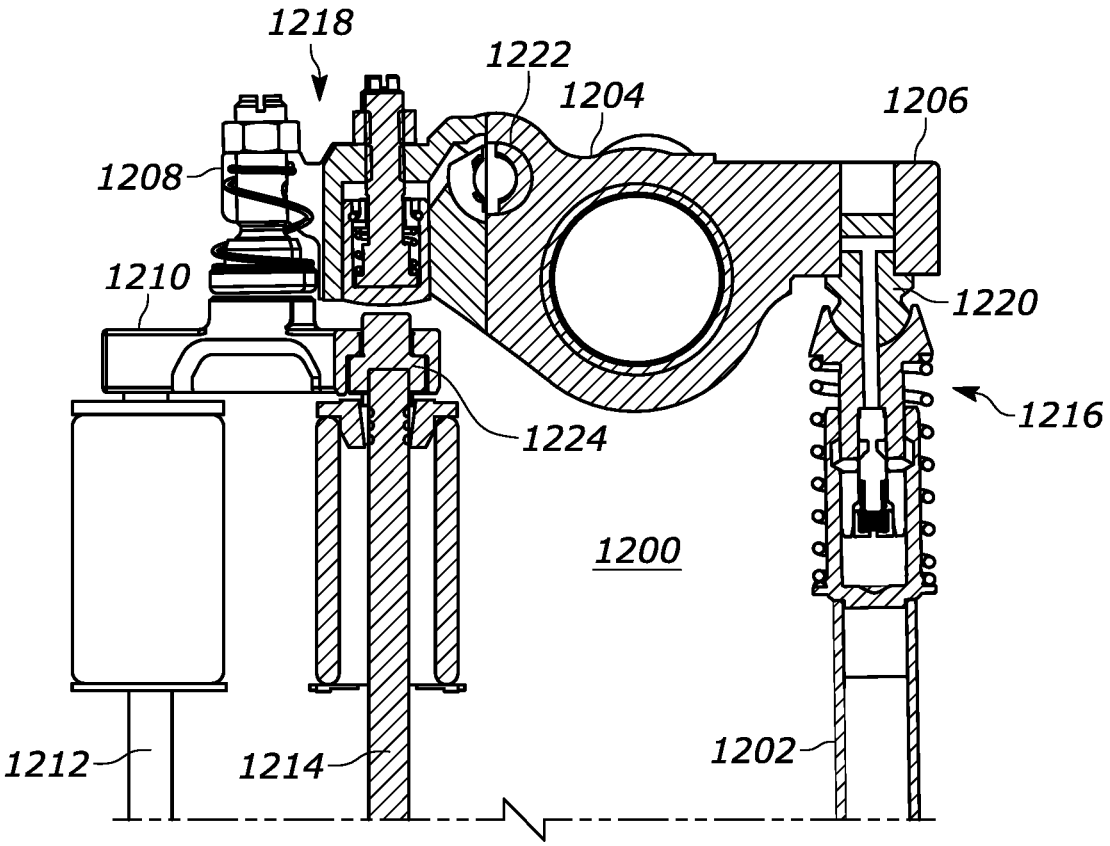
FIG. 12 is a partial cross-sectional view of first embodiment of a valve actuation system in accordance with the embodiment of FIG. 5.

FIG. 12 illustrates a partial cross-sectional view of a valve actuation system 1200 in accordance with the embodiment of FIG. 5. In this system 600 the valve actuation motion source comprises a cam (not shown) operatively connected at a motion receiving end 1206 of a rocker arm 1204 via a push tube 1202 and an intervening LM− mechanism 1216 of the type illustrated and described in FIG. 1 above. As with the embodiments illustrated in FIGS. 6-11, the rocker arm 1204 rotationally reciprocates about a rocker shaft (not shown), thereby imparting valve actuation motions provided by the valve actuation motion source, via a motion imparting end 1208 of the rocker arm 1204, to a valve bridge 1210. In turn, the valve bridge 1210 is operatively connected to a pair of engine valves 1212, 1214. As further shown, the rocker arm 1204 comprises a LM+ mechanism 1218 of the type substantially similar to that illustrated and described above relative to FIG. 2. In this case, hydraulic fluid is provided to the LM− mechanism 1216 via suitable passages formed in the rocker shaft and rocker arm 1204 and ball joint 1220. Similarly, hydraulic fluid is provided to the LM+ mechanism 1218 via suitable passages formed in the rocker shaft and rocker arm 1204. However, in this implementation, the check valve 732 of the prior embodiment is replaced by a control valve 1222 to establish the hydraulic lock required to maintain the actuator piston in an extended state. The embodiment of FIG. 12 is further characterized by the arrangement of the LM+ mechanism 1218 to interact with only a single engine valve 1214 via a suitable bridge pin 1224.

In this embodiment, the LM− mechanism 1216 includes a relatively strong spring to outwardly bias the outer plunger of the locking mechanism against the pushrod 1202 so that the pushrod 1202 is biased into contact with a cam and so that the rocker arm is biased in direction of the engine valves 1212, 1214. In this implementation, the outer plunger of the LM− mechanism 1216 is not travel limited during engine operation (as opposed to engine assembly, where imposing travel limits on the LM− mechanism 1216 facilitates assembly).

Given the configuration of the LM+ mechanism 1218, particularly the inwardly sprung actuator piston, a gap is provided between the actuator piston and the bridge pin when the LM+ mechanism 1218 is in its default state. Consequently, during this default state, the LM+ mechanism 1218 is not in series along the motion load path with the LM− mechanism 1216, as described above relative to FIG. 5. Further, despite the presence of the gap during the default state, the actuator piston would not be able to extend fully given the strength of the outer plunger piston spring as described above. In this case, then, the actuator piston is not able to fully extend until the main motion valve event has occurred, thereby creating a sufficient gap between the actuator piston and the bridge pin 1224 to permit full extension. When in the extended (activated) state, however, the actuator piston will not only convey the auxiliary valve actuation motions applied thereto, but will also convey the main valve actuation motions that are applied thereto to its corresponding engine valve 1214. In this case, the LM+ mechanism 1218 is placed in series with the LM− mechanism 1216 during the activated state of the actuator piston as described above relative to FIG. 5.

Figure 13:
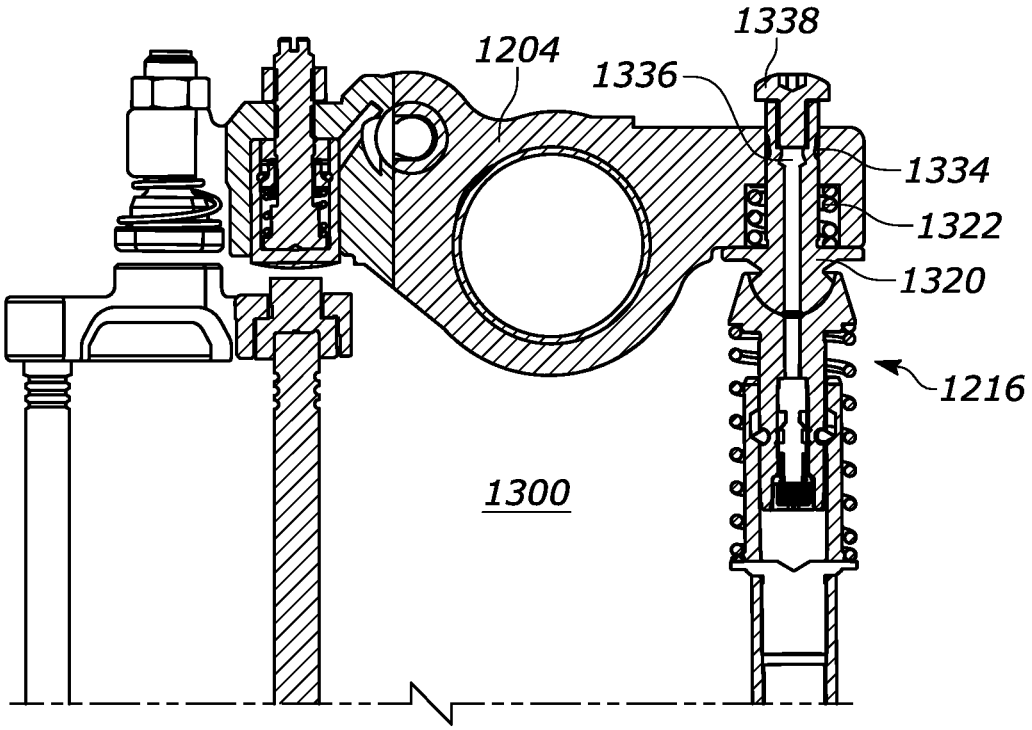
FIG. 13 is a partial cross-sectional view of a second embodiment of a valve actuation system in accordance with the embodiment of FIG. 5.

FIG. 13 illustrates a partial cross-sectional view of a valve actuation system 1300 in accordance with the embodiment of FIG. 5. In particular, the embodiment illustrated in FIG. 13 is substantially identical to the embodiment of FIG. 12 with the exception that the spherical joint 1220 is replaced with an outwardly biased, travel limited, sliding pin 1320. In this case, the outer plunger spring of the LM− mechanism 1216 is preferably designed with low preload during zero or low valve lifts (e.g., on base circle), and has a spring rate required to get the peak forces for controlling the full range of motion of the rocker arm 1204 over main valve actuation motions during deactivated mode operation.

On the other hand, a sliding pin spring 1322 used to outwardly bias the sliding pin 1320 is configured with a comparatively high preload and short stroke (substantially similar to the actuator piston spring 918 discussed above). Because the sliding piston 1320 is able to slide within its bore, the sliding piston 1320 includes an annular channel 1334 and radial opening 1336 aligned therewith such that registration of the annular channel 1334 with a fluid supply passage throughout the full stroke of sliding piston 1320 ensures continuous fluid communication between the rocker arm 1204 and the LM− mechanism 1216. Additionally, a stroke adjustment screw 1338 serves to limit travel of the sliding pin 1320 out of it bore toward the LM− mechanism 1216. As described relative to the travel limit capability applied to the actuator piston 702 above, the stroke adjustment screw 1338 prevents the full force of the sliding pin spring 1322 from being applied to the LM-mechanism 1216, which would otherwise be overloaded, potentially interfering with operation thereof. By appropriately selecting stroke provided by the stroke adjustment screw 1338, i.e., equal to the motion that must be lost by the LM+ mechanism during its default operating state, the lash provided to the locking elements within the LM− mechanism 1216 may be selected to ensure proper operation thereof, as described previously. In effect, then, the assembly of the sliding pin 1320, sliding pin spring 1322 and stroke adjustment screw 1338 constitute a portion of the LM+ mechanism in this embodiment.

As set forth above, various specific combinations of outwardly- (extended) and inwardly-sprung (retracted) elements within the LM+ and LM− mechanisms may be provided, with traveling limiting as required. More generally, in one implementation, the LM− mechanism (more specifically, an element or component thereof) may be biased into an extended position and the LM+ mechanism (again, more specifically, an element or component thereof) may be biased into a retracted position. In this case, the extended position of the LM− mechanism may be travel limited. In another implementation of any given embodiment, the LM− mechanism may be biased by a first force into an extended position and the LM+ mechanism may be biased by a second force also into an extended position. In this case, the first biasing force is preferably greater than the second biasing force. Additionally, once again, the extended position of the LM− mechanism may be travel limited. In yet another implementation, the LM− mechanism may be biased into an extended position and the LM+ mechanism may also be biased into an extended position. In this case, however, the extended position of the LM+ mechanism is travel limited. In this implementation, a possible benefit of limiting the travel of the LM+ mechanism is to allow zero load on the valvetrain on while on cam base circle to reduce bushing wear.

As noted above with respect to FIG. 4, and as shown with regard to FIG. 15 in which like reference numerals refer to like elements as compared to FIG. 4, a system 1500 may be provided in which the LM− mechanism 410' is arranged closer along the valve actuation motion path 406 to the valve actuation motion source 402 than the LM− mechanism 408'. However, unlike the system 400' of FIG. 5, the LM+ mechanism 408' shown in FIG. 15 is always in series with the LM-mechanism 410' regardless of the operating state (default or activated) of the LM+ mechanism 408' such that the LM+ mechanism 408' always plays a role in conveying main valve actuation motions conveyed by the LM− mechanism 410' and is never removed from the valve actuation load path 406.

In particular, when the LM+ mechanism 408' is in its default operating state, the LM+ mechanism 408' is configured to lose any auxiliary valve actuation motions, but to convey an main valve actuation motions, applied thereto by the valve actuation motion source 402 and the LM-mechanism 408'. On the other hand, when the LM+ mechanism 408' is in its activated operating state, i.e., when it is controlled to convey any auxiliary valve actuation motions applied thereto, the LM+ mechanism 408' participates in the conveyance of both the main valve actuation motions and the auxiliary valve actuation motions that are received from the valve actuation source 402 and LM− mechanism 410'. Thus configured, the valve actuation system 1500 facilitates operation of the cylinder 405, and consequently the internal combustion engine, in a positive power mode, a deactivated mode or an auxiliary mode (e.g., engine braking) in systems having a single valve actuation motions source 102 providing all valve actuation motions to the engine valve(s) 404. That is, the system 1500 is capable of implementing the method illustrated with reference to FIG. 14 and as described above. In this instance, however, the provisioning of the LM- and LM+ mechanisms at block 1402 occurs, respectively, in a pre-rocker valve train component and a valve bridge as described in further detail below.

Figure 16:
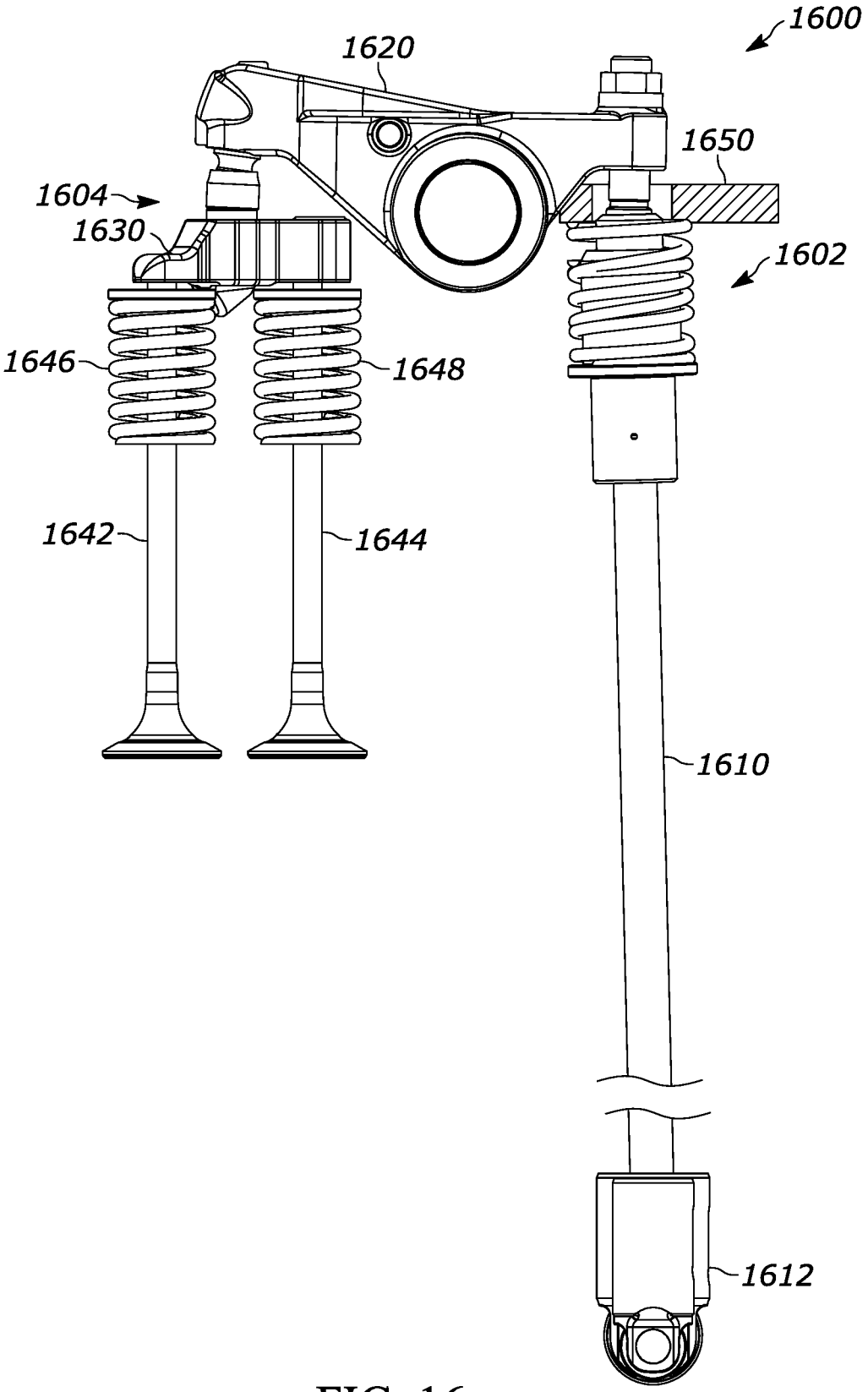
FIG. 16 is a side view of an embodiment of a valve actuation system in accordance with the embodiment of FIG. 15.
Figure 17:
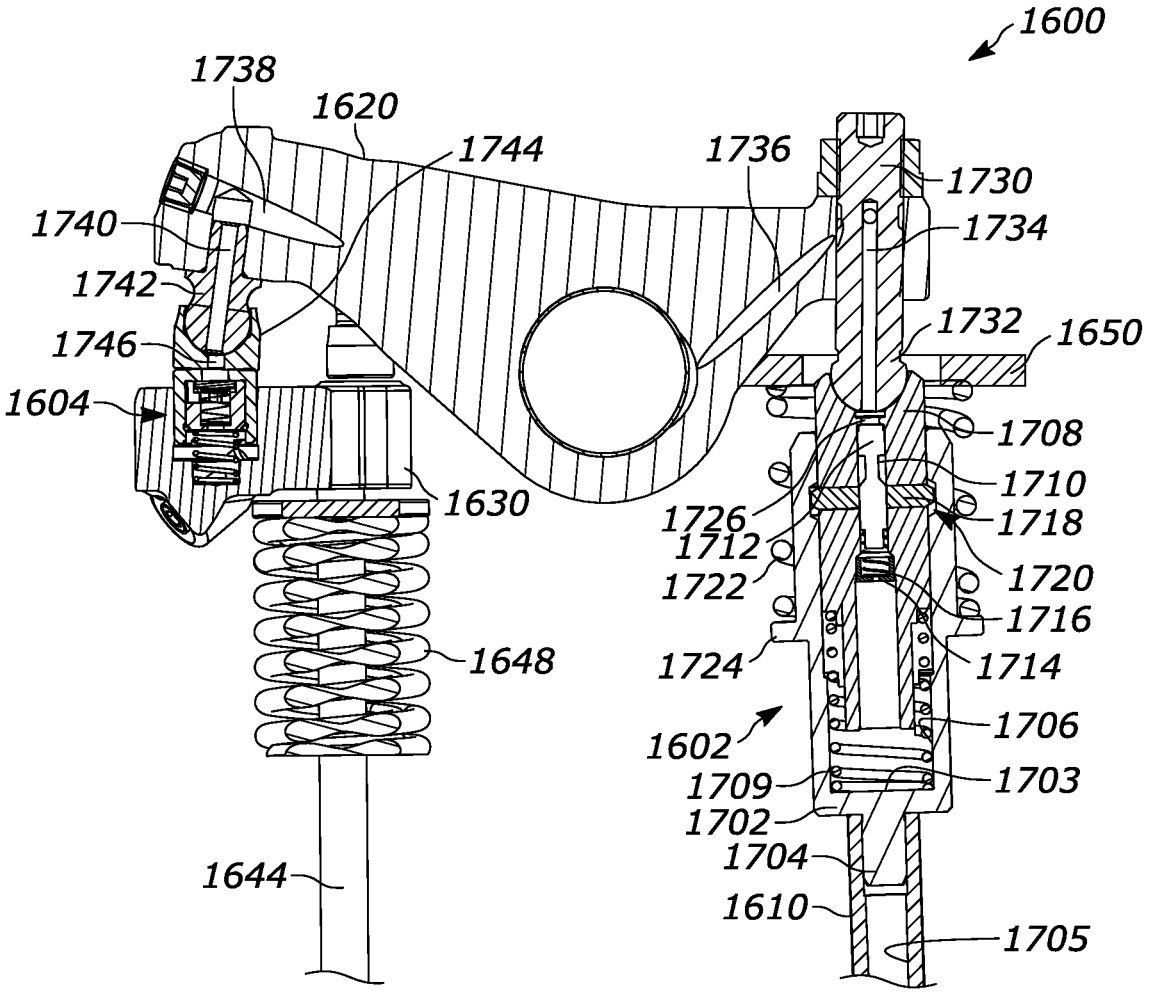
FIG. 17 is a side, cross-sectional view of the embodiment in accordance with FIG. 16.
Figure 18:
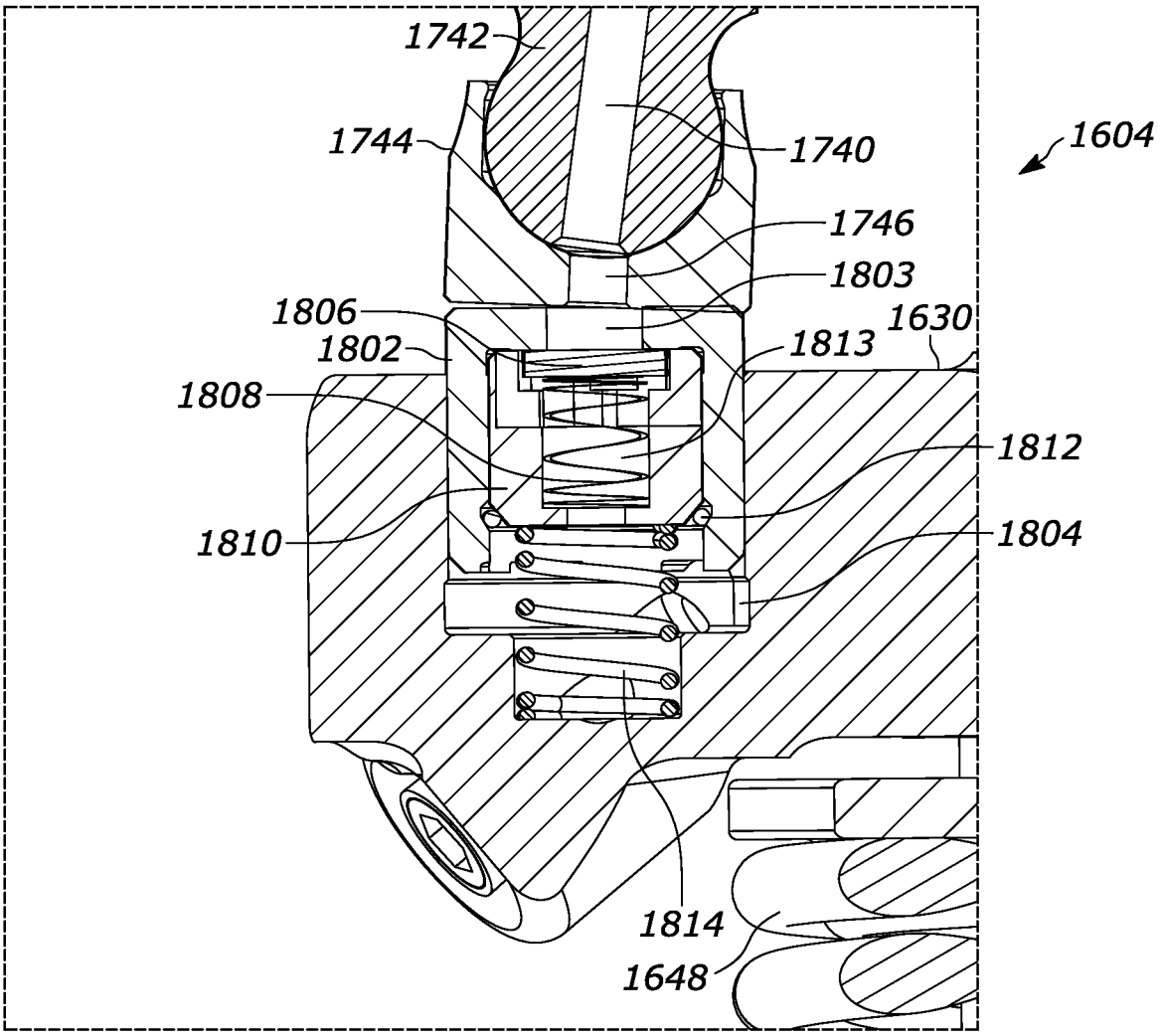
FIG. 18 is a side, cross-sectional view of the LM+ mechanism of FIG. 17 illustrated in greater detail.

FIGS. 16-18 illustrate a valve actuation system 1600 in accordance with the embodiment of FIG. 15. In this embodiment, the valve actuation system 1600 includes a LM− mechanism 1602 disposed in or on a pre-rocker arm valve train component and a LM+ mechanism 1604 disposed in a valve bridge. As used herein, a pre-rocker arm valve train component may comprise any valve train component deployed, within a valve train, between a valve actuation motion source (e.g., a cam; not shown) and a rocker arm 1620. For example, this may include devices known in the art such as pushrods, tappets, roller followers, etc. In the example illustrated in FIGS. 16 and 17, the pre-rocker arm valve train component comprises a pushrod 1610 that, in turn, is operatively connected to a roller follower 1612 establishing contact between the pushrod 1610 and a cam (not shown). In this embodiment, the LM− mechanism 1602 is mounted on an upper end of the pushrod 1610 such that the LM− mechanism 1602 in operatively connected with both the pushrod 1610 and rocker arm 1620. Further this example, the rocker arm 1620 is mounted on a rocker shaft (not shown) for reciprocating movement thereon. In turn, the rocker arm 1620 is operatively connected to a valve bridge 1630 in which the LM+ mechanism 1604 is deployed. In keeping with conventional internal combustion engines, the valve bridge 1630 is operative connected to a two or more engine valves 1642, 1644 (intake or exhaust valves) that are biased into a closed position by corresponding valve springs 1646, 1648. FIG. 16 further illustrates a fixed reaction surface 1650 that contacts an upper end of the LM− mechanism 1602, as described in further detail below.

Referring now to FIGS. 17 and 18, further details of the embodiment of FIG. 16 are illustrated and described. As noted above, the pushrod 1610 has the LM− mechanism 1602 mounted thereon. In this embodiment, the LM− mechanism 1602 comprises a housing 1702 mounted on the pushrod 1610 through an interference fit or threaded engagement between a stud 1704 extending away from a base wall 1703 of the housing 1702 and an interior diameter 1705 of the pushrod 1610. Alternatively, the housing 1702 may be integrally formed as a portion of the pushrod 1610 or the pushrod 1610 may be inserted into a receptacle formed on an exterior of the base wall 1703 of the housing 1702. A closed housing bore 1706 is formed the housing 1702 and is configured to receive an outer plunger 1708, an inner plunger 1712, an inner plunger spring retainer 1714, an inner plunger spring 1716, an outer plunger spring 1709, and one or more locking elements 1718, illustrated in this embodiment as wedges. The outer plunger spring 1709, disposed within the housing bore 1706 and between the base wall 1703 and the outer plunger 1708, biases the outer plunger 1708 upward in the housing bore 1706 (as illustrated in FIG. 17). The inner plunger 1712 is disposed in an inner bore 1710 formed in the outer plunger 1708. The inner plunger spring 1716, disposed between the inner plunger spring retainer 1714 (which is affixed to and closes off a lower end of the inner bore 1710) and the inner plunger 1712, bias the inner plunger 1712 upward in the inner bore 1710. Upward travel of the inner plunger 1712 is limited by a stop surface 1726 formed at an upper end of the inner bore 1710. The outer plunger 1708 includes openings extending through the sidewall of the outer plunger 1708 in which the wedges 1718 are disposed, which wedges 1718 are configured to engage with an annular outer recess 1720 formed in a surface defining the housing bore 1706.

In the absence of hydraulic control applied to the inner plunger 1712 via the opening at the upper end of the inner bore 1710, i.e., the default state of the LM− mechanism 1602 as illustrated in FIG. 17, the inner piston spring 1716 biases the inner plunger 1712 into position such that the wedges 1718 extend out of the openings formed in the outer plunger 1708, thereby engaging the outer recess 1720 and effectively locking the outer plunger 1708 in place relative to the housing 1702. In this default state, any valve actuation motions (whether main or auxiliary motions) applied to the push tube 1610 are conveyed by the LM− mechanism 1602 by virtue of the outer plunger 1708 being effectively locked into position relative to the housing 1702. However, provision of sufficiently pressurized hydraulic fluid to the top of the inner plunger 1712 causes the inner plunger 1712 to slide downward such that the wedges 1718 are permitted to retract and disengage from the outer recess 1720, thereby effectively unlocking the outer plunger 1708 relative to the housing 1702 and permitting the outer plunger 1708 to slide freely within the housing bore 1706, subject to a bias provided by the outer plunger spring 1709. In this activated state, any valve actuation motions applied by the pushrod 1610 to the housing 1702 will cause the pushrod 1610 and housing 1702 to reciprocate according to the applied actuation motions while the outer plunger 1708 remains stationary. In this manner, and presuming the travel of the outer plunger 1708 within the housing bore 1706 is greater than the maximum extent of any applied valve actuation motions, such valve actuation motions are not conveyed to the engine valves and are effectively lost such that the corresponding cylinder is deactivated.

Further the illustrated embodiment, a bias spring 1722 is disposed between and in contact with a flange 1724, formed on and radially extending away from an outer surface of the housing 1702, and the fixed contact surface 1650. As shown, the fixed contact surface 1650 is configured to permit passage to the outer plunger 1708 into contact with a lash adjustment screw 1730 disposed on the rocker arm 1620 while still engaging with an upper end of the bias spring 1722. The bias spring 1722 is provided to manage the inertia of the pushrod 1610 and the LM-mechanism 1602 as they reciprocate according to the valve actuation motions applied to the pushrod 1610, and to ensure that the pushrod 1610 (via the roller follower 1612 in this example) maintains contact with the valve actuation motion source. Use of the fixed contact surface 1650 for this purpose prevents the relatively large bias applied by the bias spring 1722 from being also applied to the LM+ mechanism 1604 (via the rocker arm 1620) and interfering with operation thereof. In comparison, the outer plunger spring 1709 is a relatively light spring sufficient to bias the outer plunger 1708 into contact with the rocker arm 1620/lash adjustment screw 1730 but not so strong, once again, as to interfere with operation of the LM+ mechanism 1604.

As known in the art, a rocker shaft (not shown) may be provided with channels for supplying pressurized hydraulic fluid to hydraulic passages 1736, 1738 formed in the rocker arm 1620. As further known in the art, supply of such hydraulic fluid may be controlled through the use of suitable solenoids (not shown) under supervision of the controller 420. The hydraulic passages 1736, 1738 route hydraulic fluid to respective ones of the LM− mechanism 1602 and the LM+ mechanism 1604. By selectively controlling flow of the hydraulic fluid through the respective passages 1736, 1738, the respective default/activated states of the LM- and LM-mechanisms 1602, 1604 may be likewise controlled.

To this end, the rocker arm 1620 is equipped with a lash adjustment screw 1730, as known in the art having a first fluid passage 1734 formed therein and terminating in a ball joint 1732. The ball joint 1732 is formed to engage a complementarily configured upper surface of the outer plunger 1708 such that fluid communication between the first fluid passage 1734 and the inner bore 1710 is provided throughout all operations of the valve actuation system 1600. The first hydraulic passage 1736 is in fluid communication with the first fluid passage 1734 such that hydraulic fluid may be selectively provided as a control input to the LM− mechanism 1602 as described above.

Similarly, the rocker arm 1620 is equipped, in this example, with a ball joint 1742 having a second fluid passage 1740 formed therein and in communication with the second hydraulic passage 1738. The ball joint 1742 is coupled to a swivel or e-foot 1744 having an opening 1746 formed therein such that fluid communication is continuously provided between the first fluid passage 1740 and the LM+ mechanism 1604. Once again, this continuous fluid communication permits hydraulic fluid to be selectively provided as a control input to the LM+ mechanism 1604 as described above.

Further detail of the LM+ mechanism 1604 is further illustrated with respect to FIG. 18. In particular, the LM+ mechanism 1604 comprises lost motion piston 1802 disposed in a closed, centrally-formed bore 1804 in the valve bridge 1630. The lost motion piston 1802 comprises a piston opening 1803 providing fluid communication between the first fluid passage 1740/opening 1746 and an interior bore 1813 formed in the lost motion piston 1802. The lost motion piston 1802 further comprises a check valve assembly comprising a check disc (or ball) 1802, a check spring 1808, a check spring retainer 1810 and a retainer clip 1812 disposed in the bore 1813. The retainer clip 1812 maintains the check spring retainer 1810 in a fixed position within the bore 1813 such that the check spring 1808 continuously biases the check disc 1806 into contact with an upper wall of the lost motion piston 1802, thereby sealing the first fluid passage 1740 from the bore 1813 in the absence of sufficiently pressurized hydraulic fluid provided from the first fluid passage 1740. The lost motion piston 1802 is biased out of the bore 1804 and into contact with the swivel 1744 by a piston spring 1814 disposed in the bore 1804, thereby ensuring continuous contact, and therefore continuous fluid communication, between the lost motion piston 1802 and the swivel 1744.

As known in the art, the lost motion piston 1802 is configured to travel a distance (lost motion lash) that is at least as large as any auxiliary valve actuation motions applied thereto by the rocker arm 1620. Thus, when hydraulic fluid is not provided to the lost motion piston 1802 and its check valve assembly, the lost motion piston 1802 will retract into and bottom out in the bore 1804 under the influence of the bias applied to the rocker arm 1620 by the outer plunger spring 1709 via the outer plunger 1708, and remain bottomed out in the bore 1804 when valve actuation motions are applied to the lost motion piston 1802. Because the amount of travel of the lost motion piston 1802 is at least as large as any auxiliary valve actuation motions applied thereto, such auxiliary valve actuation motions will be lost in this circumstance, whereas larger valve actuation motions, such as main event valve actuations, will be conveyed through the lost motion piston 1802 to the valve bridge 1630.

However, when sufficiently pressurized hydraulic fluid is provided to the lost motion piston 1802 via the check valve assembly, hydraulic fluid will flow past the check disc 1806 and into the bore 1804 beneath the lost motion piston 1802. As known in the art, this will establish a locked volume of relatively incompressible hydraulic fluid behind the lost motion piston 1802, thereby causing the lost motion piston 1802 to extend out of its bore 1804 and remain in is extended state while valve actuation motions are applied thereto. As a result, all valve actuation motions applied to the lost motion piston 1802 (both main and auxiliary valve actuation motions) will be conveyed to the valve bridge 1630.

As noted above, the embodiment of illustrated in FIGS. 16-18 is based on the use of a pushrod as the pre-rocker arm valve train component configured to include the LM− mechanism. However, as further noted above, the pre-rocker arm valve train component may be implemented using other valve train components. For example, in an embodiment, the LM− mechanism, such as the above-described locking mechanism, could be implemented in a cam follower, lifter or similar component. In this case, the hydraulic fluid required to control the locking mechanism could be provided through suitable passages formed in the pushrod or using other hydraulic fluid provisioning techniques known to those skilled in the art.

What is claimed is:

1. A valve actuation system for use in an internal combustion engine comprising a cylinder, at least one engine valve associated with the cylinder, a rocker arm, and a valve actuation load path comprising a valve bridge and a pre-rocker arm valve train component each operatively connected to the rocker arm, the valve actuation system comprising:

a single cam configured to provide a main valve actuation motion and an auxiliary valve actuation motion so as to actuate the at least one engine valve via the valve actuation load path;

a lost motion subtracting mechanism arranged in the pre-rocker arm valve train component and configured, in a first default operating state, to convey at least the main valve actuation motion and configured, in a first activated state, to lose the main valve actuation motion and the auxiliary valve actuation motion; and a lost motion adding mechanism arranged in the valve bridge and configured, in a second default operating state, to lose the auxiliary valve actuation motion and configured, in a second activated state, to convey the auxiliary valve actuation motion, wherein the lost motion adding mechanism is arranged in series with the lost motion subtracting mechanism in the valve actuation load path.

2. The valve actuation system of claim 1, further comprising:

an engine controller configured to operate the internal combustion engine, using the lost motion subtracting mechanism and the lost motion adding mechanism, in:

a positive power mode in which the lost motion subtracting mechanism is in the first default operating state and the lost motion adding mechanism is in the second default operating state, or a deactivated mode in which the lost motion subtracting mechanism is in the first activated operating state and the lost motion adding mechanism is in the second default operating state, or an auxiliary mode in which the lost motion subtracting mechanism is in the first default operating state and the lost motion adding mechanism is in the second activated operating state.

3. The valve actuation system of claim 1, wherein the auxiliary valve actuation motion is at least one of an early exhaust valve opening valve actuation motion, a late intake valve closing valve actuation motion or an engine braking valve actuation motion-.

4. The valve actuation system of claim 1, wherein the lost motion subtracting mechanism is a hydraulically-controlled, mechanical locking mechanism.

5. The valve actuation system of claim 1, wherein the lost motion adding mechanism is a hydraulically-controlled actuator.

6. The valve actuation system of claim 5, wherein the lost motion adding mechanism further comprises a hydraulically-controlled check valve providing hydraulic fluid to the hydraulically-controlled actuator.

7. The valve actuation system of claim 1, further comprising:

a first spring configured to bias the pre-rocker arm component toward the single cam.

8. The valve train actuation system of claim 7, wherein the pre-rocker arm component comprises a pushrod and wherein the first spring is operatively connected to the pushrod.

9. The valve actuation system of claim 7, wherein the second spring is disposed in the lost motion adding mechanism.

10. The valve actuation system of claim 1, further comprising:

a second spring configured to bias the rocker arm toward the single cam.

11. A method of operating an internal combustion engine comprising a cylinder, at least one engine valve associated with the cylinder, a rocker arm, and a single cam configured to provide a main valve actuation motion and an auxiliary valve actuation motion so as to actuate the at least one engine valve via a valve actuation load path comprising a valve bridge and a pre-rocker arm valve train component each operatively connected to the rocker arm, the method comprising:

providing a lost motion subtracting mechanism arranged in the pre-rocker arm valve train component and configured, in a first default operating state, to convey at least the main valve actuation motion and configured, in a first activated state, to lose the main valve actuation motion and the auxiliary valve actuation motion;

providing a lost motion adding mechanism arranged in the valve bridge and configured, in a second default operating state, to lose the auxiliary valve actuation motion and configured, in a second activated state, to convey the auxiliary valve actuation motion, wherein the lost motion adding mechanism is arranged in series with the lost motion subtracting mechanism in the valve actuation load path; and operating the internal combustion engine in:

a positive power mode in which the lost motion subtracting mechanism is in the first default operating state and the lost motion adding mechanism is in the second default operating state, or a deactivated mode in which the lost motion subtracting mechanism is in the first activated operating state and the lost motion adding mechanism is in the second default operating state, or an auxiliary mode in which the lost motion subtracting mechanism is in the first default operating state and the lost motion adding mechanism is in the second activated operating state.

* * * * *